US006376980B1

(12) United States Patent
Misono

(10) Patent No.: US 6,376,980 B1
(45) Date of Patent: Apr. 23, 2002

(54) CRT HAVING AN ELECTRON GUN WITH MAGNETIC PIECES ATTACHED TO ONE OF A PLURALITY OF ELECTRODES, CONFIGURED TO CORRECT DEFLECTION DEFOCUSING

(75) Inventor: Masayoshi Misono, Chousei-gun (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/587,290

(22) Filed: Jun. 5, 2000

Related U.S. Application Data

(63) Continuation of application No. 08/949,764, filed on Oct. 14, 1997, now Pat. No. 6,201,344.

(30) Foreign Application Priority Data

Oct. 14, 1996 (JP) ..... 8-270950

(51) Int. Cl.[7] ..... H01J 29/76

(52) U.S. Cl. ..... 313/433; 313/414; 313/413

(58) Field of Search ..... 313/413, 414, 313/433, 412, 439, 449, 440, 452, 425, 431

(56) References Cited

U.S. PATENT DOCUMENTS

| | | | | |
|---|---|---|---|---|
| 3,952,224 A | | 4/1976 | Evans, Jr. | |
| 4,086,513 A | | 4/1978 | Evans, Jr. | |
| 4,641,058 A | | 2/1987 | Koshigoe et al. | 313/449 |
| 4,877,993 A | | 10/1989 | Ogasa | 313/414 |
| 5,113,112 A | | 5/1992 | Shimona et al. | 313/412 |
| 5,350,967 A | | 9/1994 | Chen | 313/413 |
| 5,412,277 A | | 5/1995 | Chen | 313/414 |
| 5,912,530 A | * | 6/1999 | Misono et al. | 313/412 |
| 6,005,339 A | * | 12/1999 | Misono | 313/413 |

FOREIGN PATENT DOCUMENTS

| | | |
|---|---|---|
| JP | 51-61766 | 5/1976 |
| JP | 51-64368 | 5/1976 |
| JP | 53-18866 | 6/1978 |
| JP | 54-139372 | 10/1979 |
| JP | 60-07345 | 2/1985 |
| JP | 60-81736 | 5/1985 |
| JP | 63-294653 | 12/1988 |
| JP | 4-52586 | 8/1992 |
| JP | 4-324229 | 11/1992 |
| JP | 5-74367 | 3/1993 |
| JP | 6-36704 | 2/1994 |
| JP | 7-21938 | 1/1995 |
| JP | 7-78573 | 3/1995 |
| JP | 7-211258 | 8/1995 |

* cited by examiner

*Primary Examiner*—Michael H. Day
*Assistant Examiner*—Joseph Williams
(74) *Attorney, Agent, or Firm*—Antonelli, Terry, Stout & Kraus, LLP

(57) ABSTRACT

A cathode ray tube includes a phosphor screen, an electron gun having a plurality of electrodes, a deflection device, and a plurality of magnetic pieces being disposed on opposite sides in a direction of scanning line of an electron beam of a trajectory of and undetected electron beam in a magnetic deflection field generated by the deflection device. The plurality of magnetic pieces have a portion extending in a direction of an axis of the cathode ray tube on each of the opposite sides. The portion includes a pair of parts disposed above and below a plane containing the axis and the scanning line and having a first axial length greater than a second axial length of the portion as measured in the plane.

20 Claims, 29 Drawing Sheets

MAGNETIC FLUX DENSITY DISTRIBUTION ON A LINE Y-Y

MAGNETIC FLUX DENSITY DISTRIBUTION ON A LINE Y-Y

MAGNETIC FLUX DENSITY DISTRIBUTION ON A LINE Y-Y

MAGNETIC FLUX DENSITY DISTRIBUTION ON A LINE Y-Y

MAGNETIC FLUX DENSITY DISTRIBUTION ON A LINE Y-Y

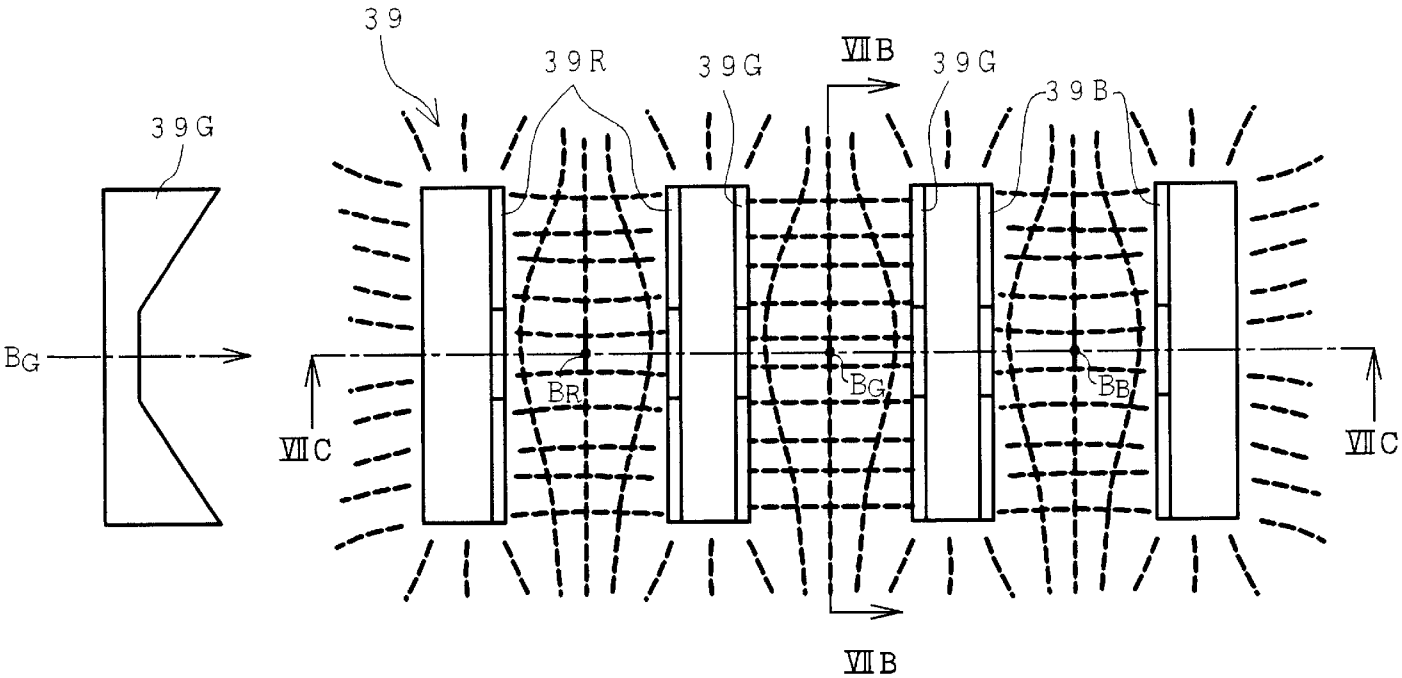
FIG. 7A
FIG. 7B
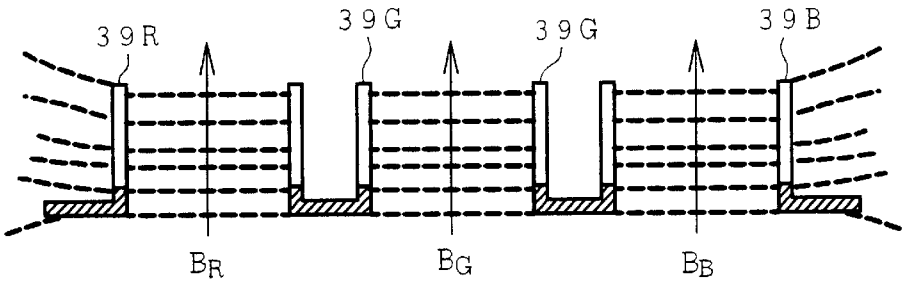
FIG. 7C

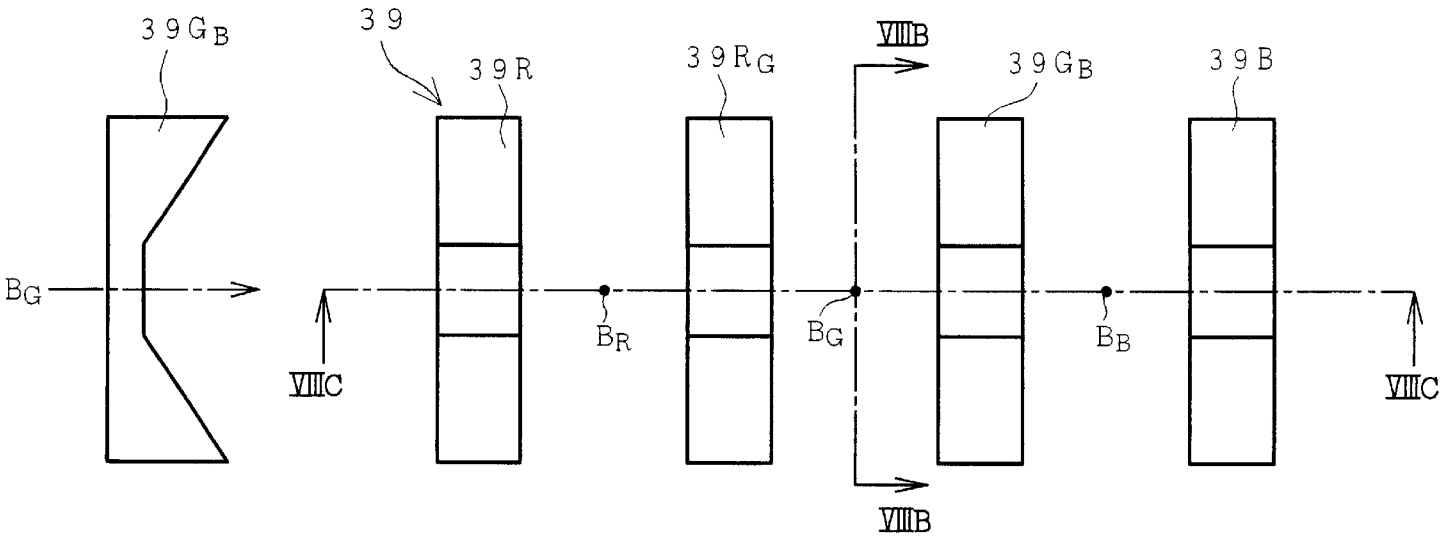
FIG. 8A
FIG. 8B
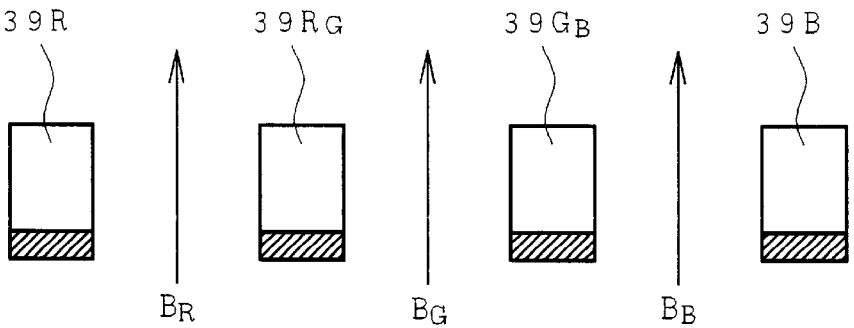
FIG. 8C

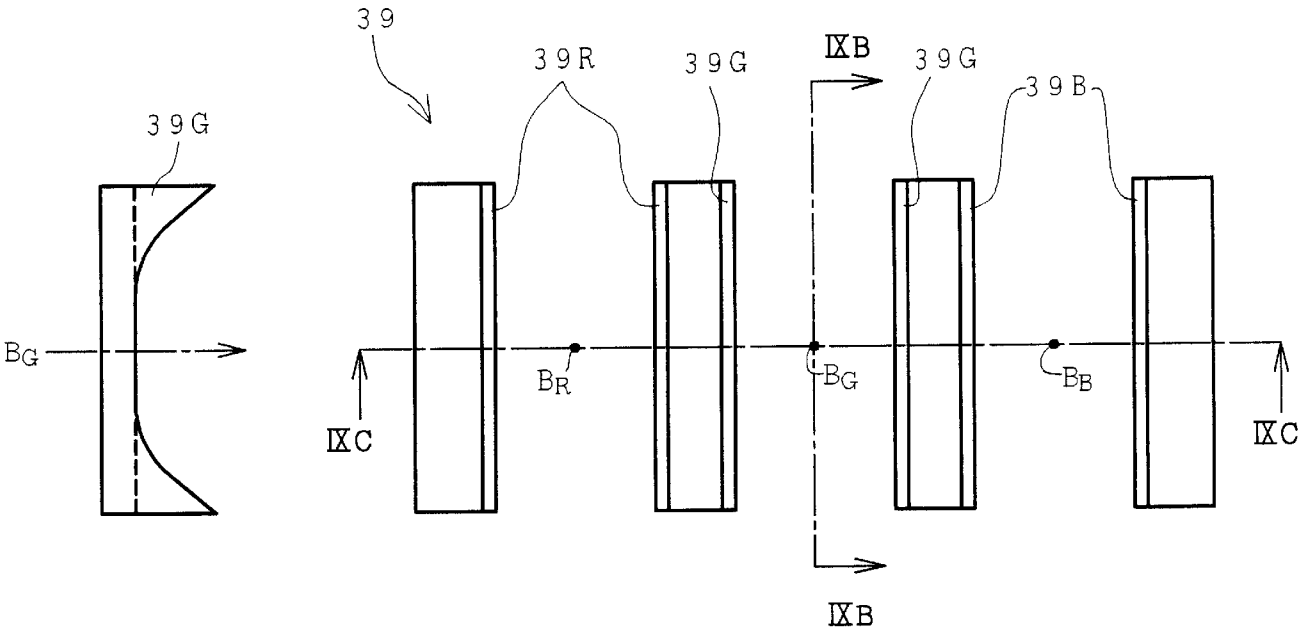
FIG. 9A
FIG. 9B
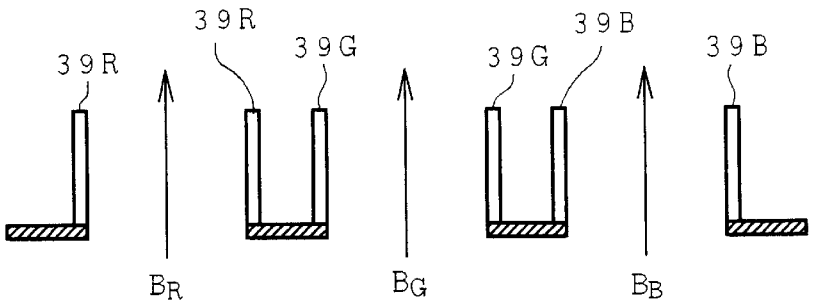
FIG. 9C

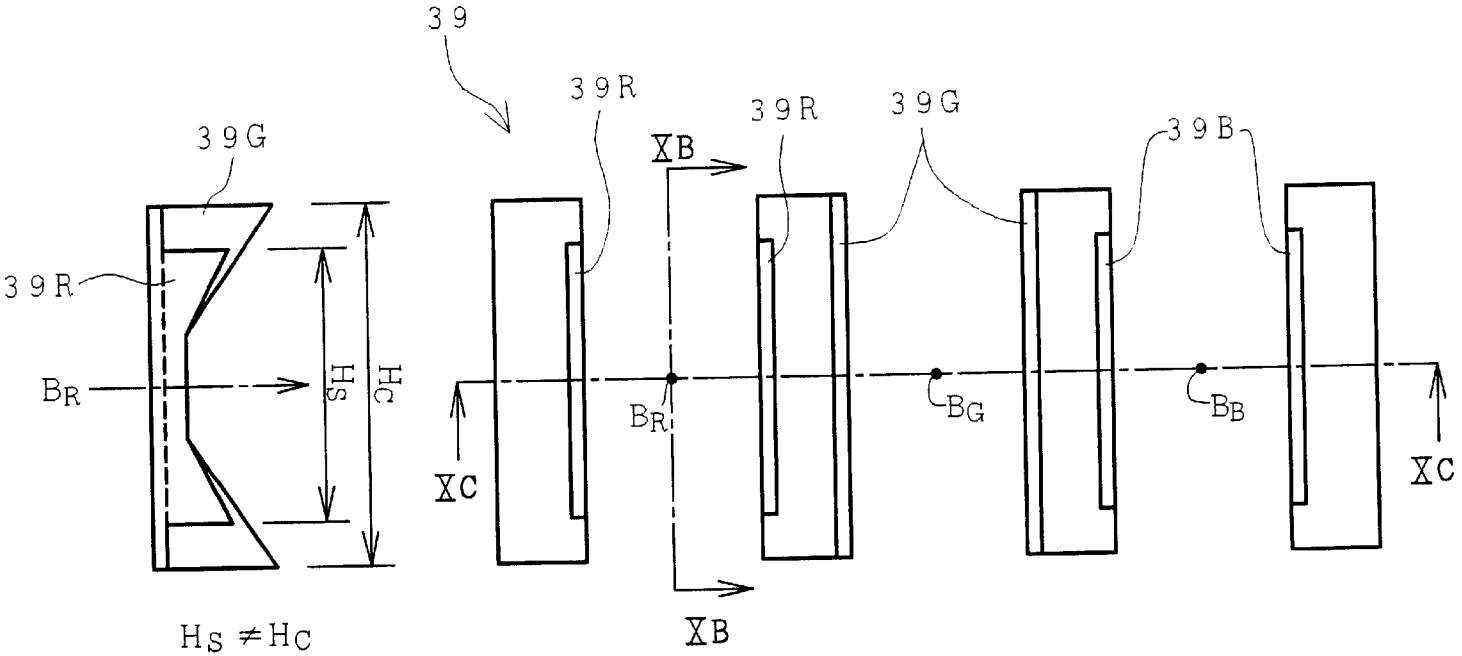
FIG. 10A
FIG. 10B
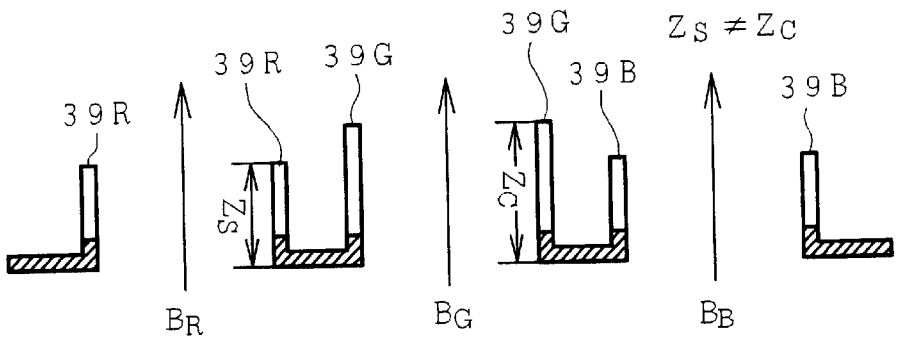
FIG. 10C

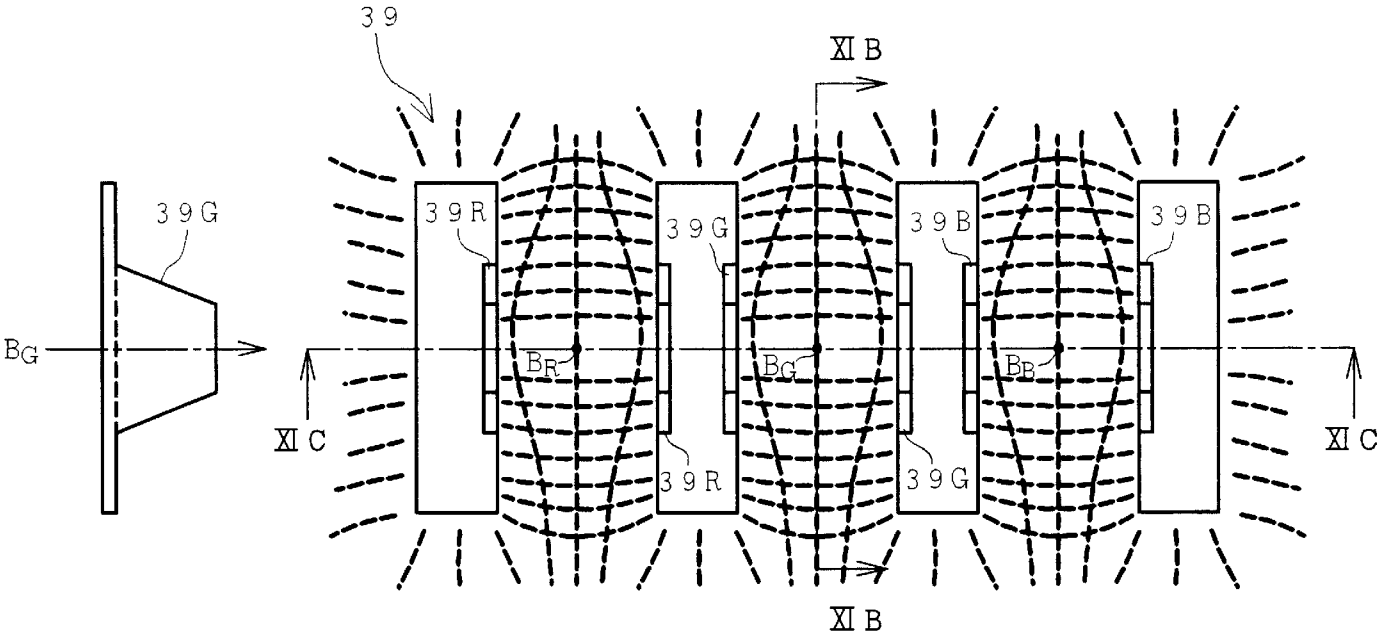
FIG. 11A
FIG. 11B
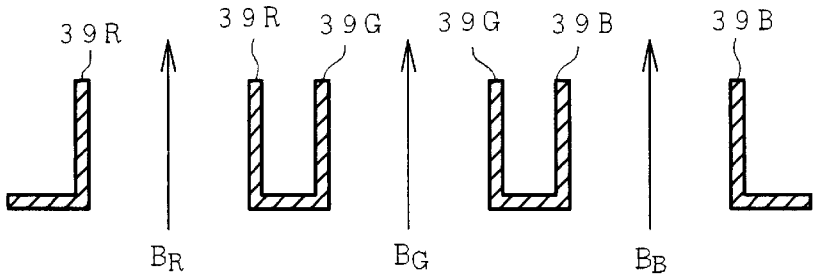
FIG. 11C

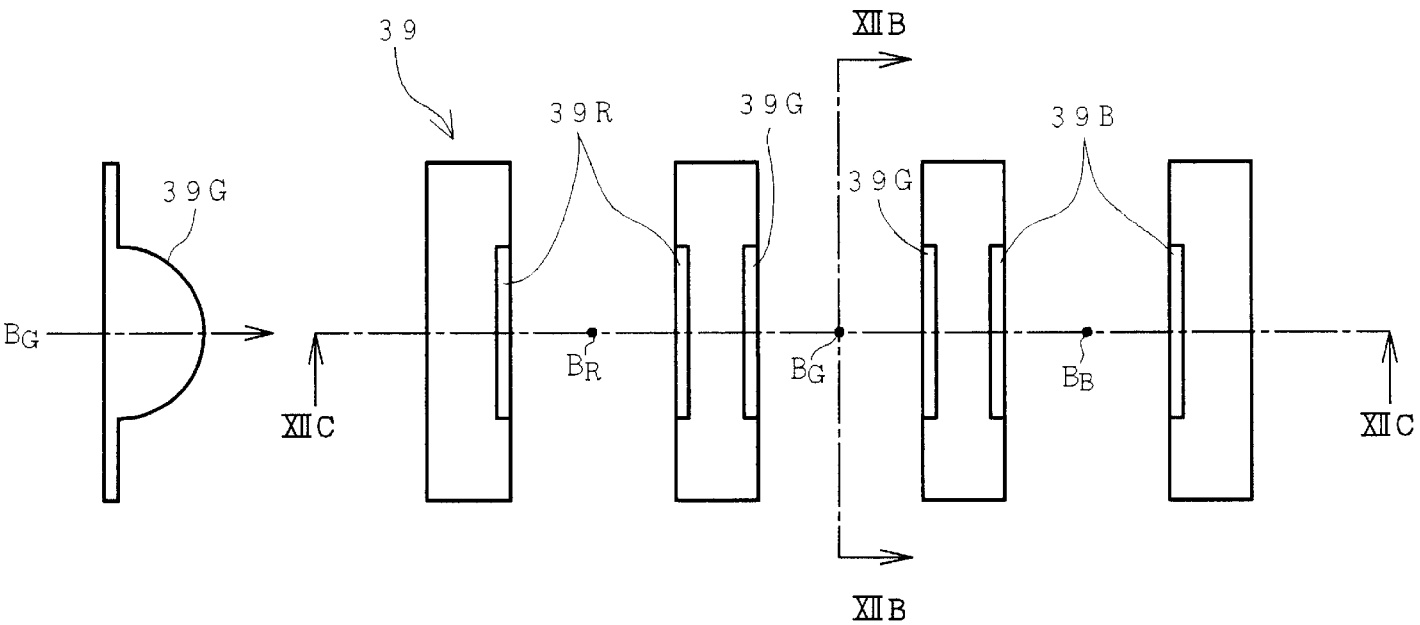
FIG. 12A
FIG. 12B
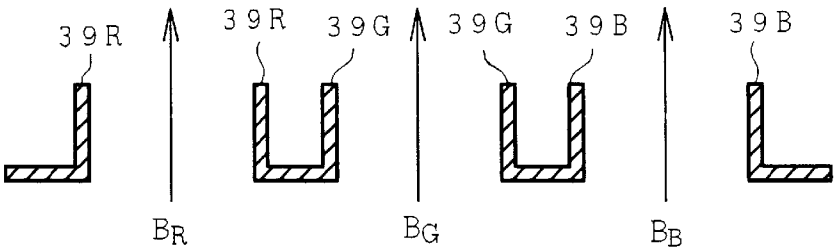
FIG. 12C

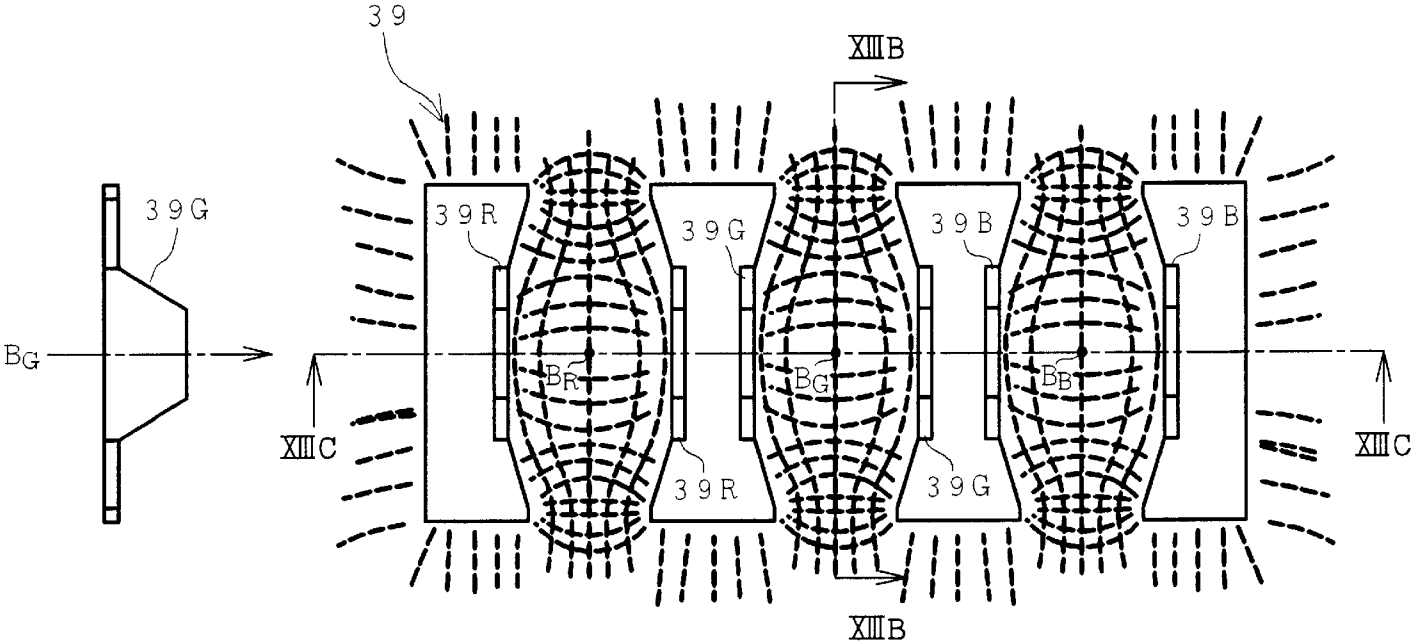
FIG. 13A
FIG. 13B
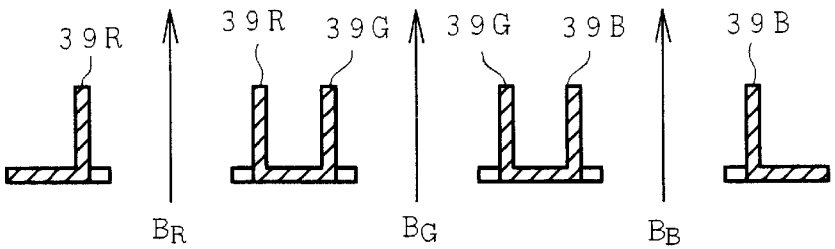
FIG. 13C

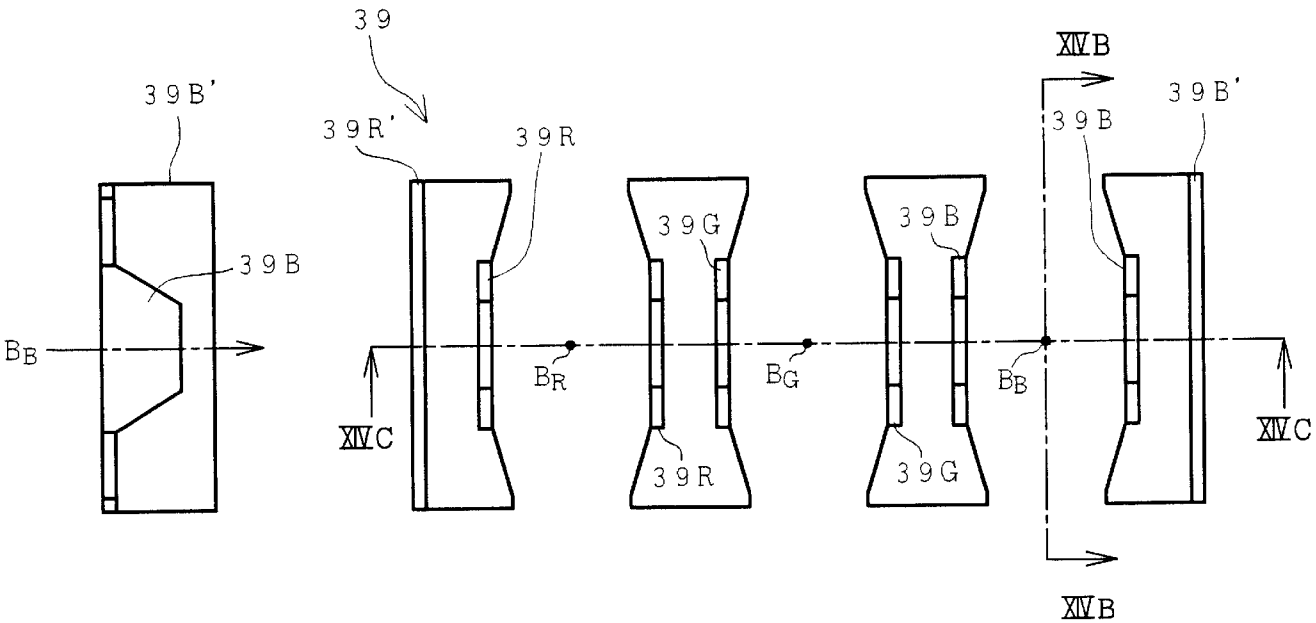
FIG. 14A
FIG. 14B
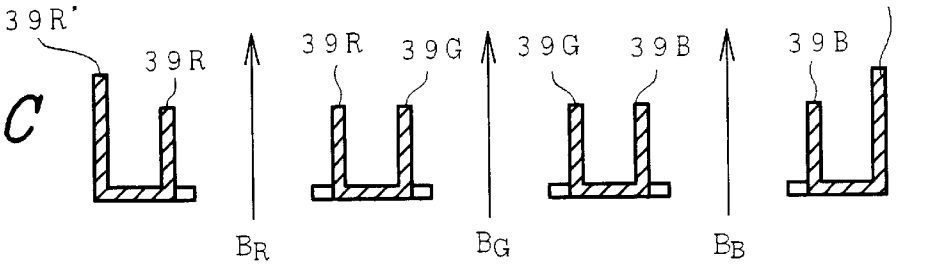
FIG. 14C

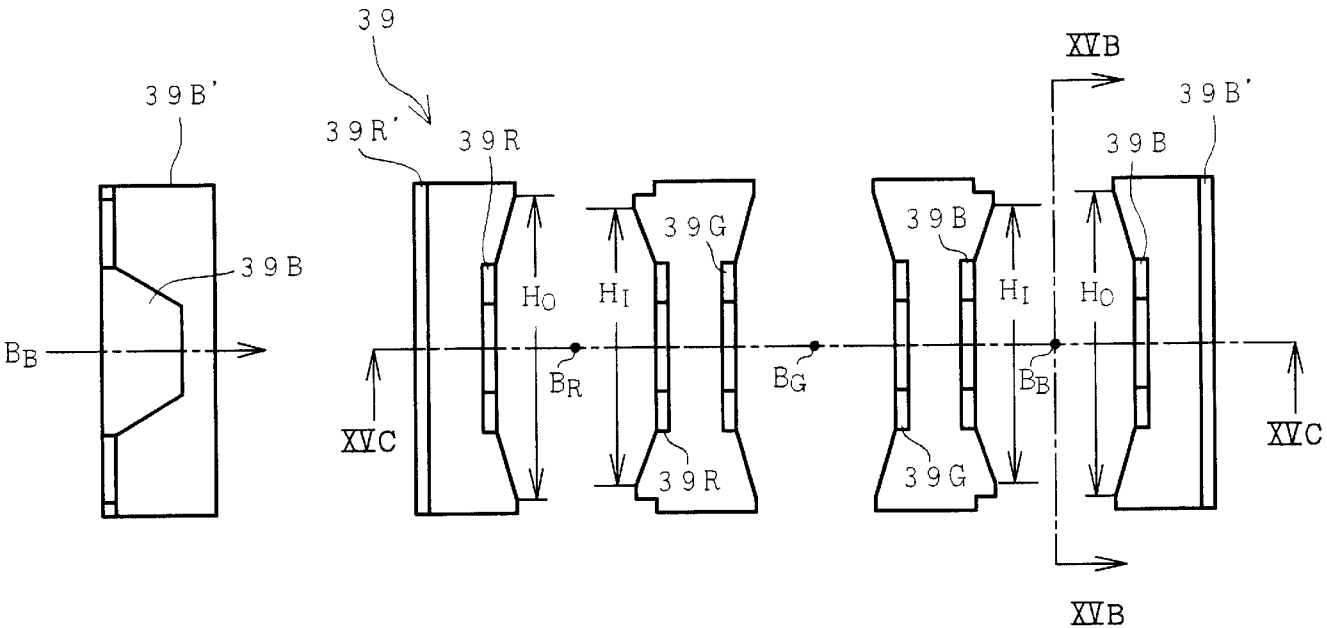
FIG. 15A
FIG. 15B
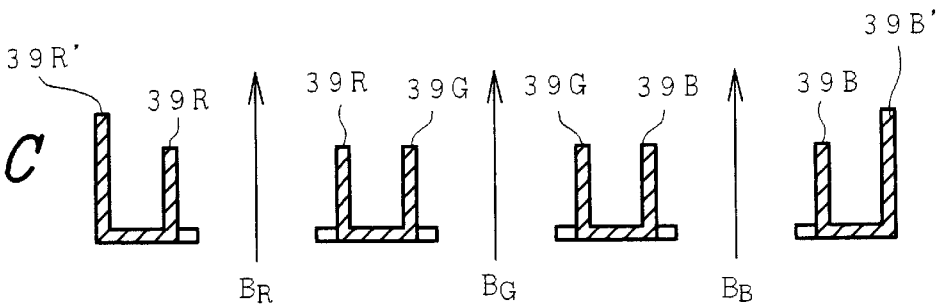
FIG. 15C

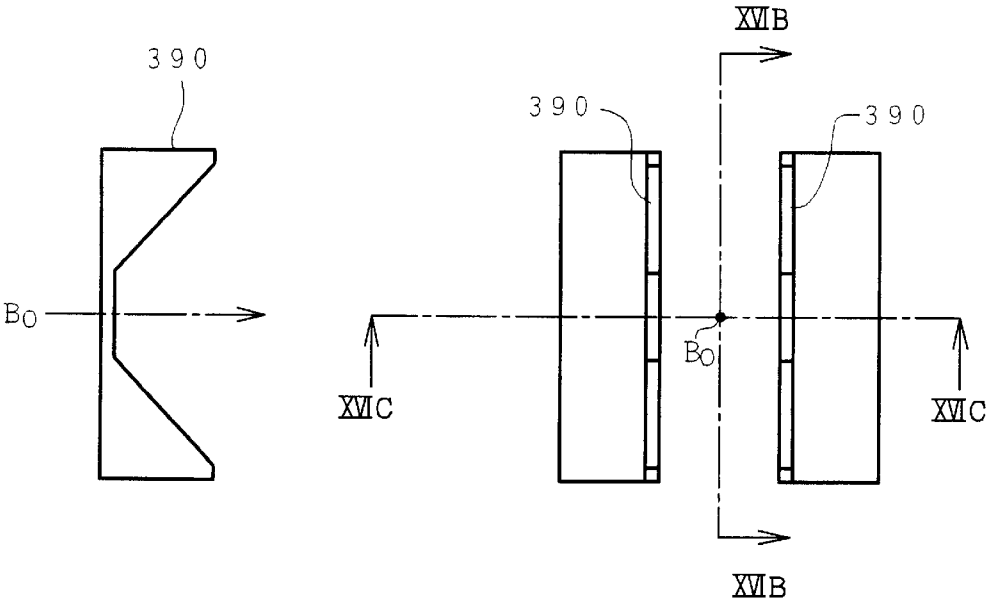
FIG. 16A
FIG. 16B
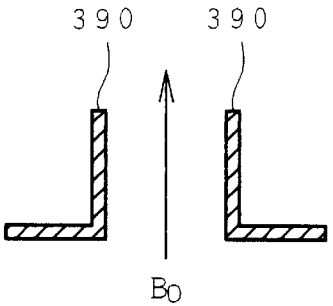
FIG. 16C

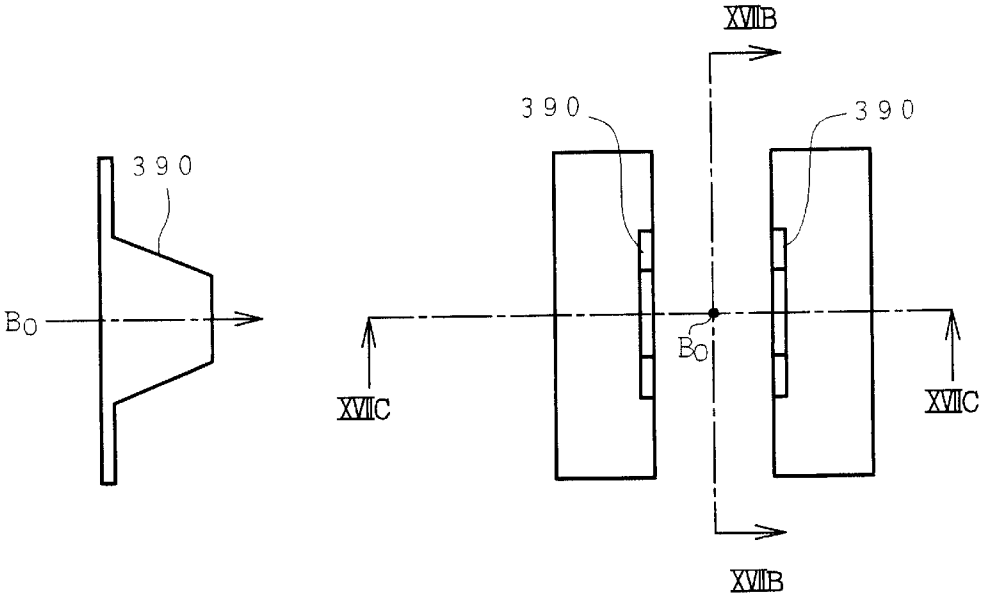
FIG. 17A
FIG. 17B
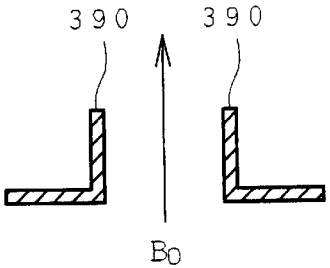
FIG. 17C

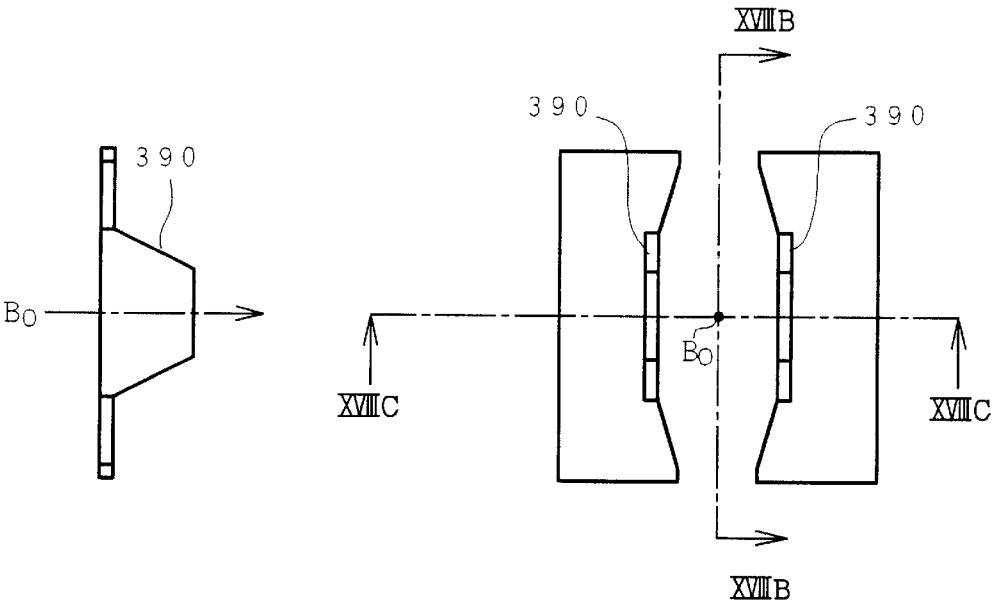
FIG. 18A
FIG. 18B
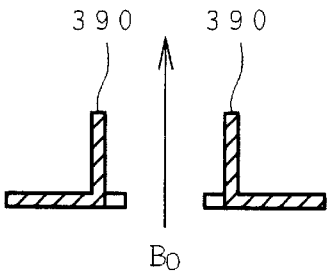
FIG. 18C

CRT HAVING AN ELECTRON GUN WITH MAGNETIC PIECES ATTACHED TO ONE OF A PLURALITY OF ELECTRODES, CONFIGURED TO CORRECT DEFLECTION DEFOCUSING

CROSS REFERENCE TO RELATED APPLICATION

This is a continuation of U.S. application Ser. No. 08/949,764, filed Oct. 14, 1997 now U.S. Pat No. 6,201,344, the subject matter of which is incorporated by reference herein.

BACKGROUND OF THE INVENTION

The present invention relates to a cathode ray tube (CRT), and particularly to a cathode ray tube having an electron gun capable of improving focus characteristics, correcting deflection defocusing and thereby providing good resolution over the entire phosphor screen and over the entire electron beam current region.

A cathode ray tube such as a picture tube or a display tube includes at least an electron gun having a plurality of electrodes and a phosphor screen (a screen having a phosphor film, which is also referred to as "a phosphor film" or simply to "a screen" hereinafter), and it also includes a deflection device for scanning an electron beam emitted from the electron gun over the phosphor screen.

For such a cathode ray tube, there have been known the following techniques for obtaining a good reproduced image over the entire phosphor screen from the center to the peripheral portions.

Japanese Patent Publication No. Hei 4-52586 discloses an electron gun emitting three in-line electron beams in which a pair of parallel flat electrodes are disposed on the bottom face of a shield cup in such a manner as to be positioned above and below paths of the three electron beams in parallel to the in-line direction and to extend toward a main lens.

U.S. Pat. No. 4,086,513 and its corresponding Japanese Patent Publication No. Sho 60-7345 discloses an electron gun emitting three in-line electron beams in which a pair of parallel flat electrodes are disposed above and below paths of the three electron beams in parallel to the in-line direction in such a manner as to extend from one of facing ends of one of a pair of main-lens-forming electrodes toward a phosphor screen, thereby shaping the electron beams before the electron beams enter a deflection magnetic field.

Japanese Patent Laid-open No. Sho 51-61766 discloses an electron gun in which an electrostatic quadrupole lens is formed between two electrodes and the strength of the electrostatic quadrupole lens is made to vary dynamically with the deflection of an electron beam, thereby achieving uniformity of an image over the entire screen.

Japanese Patent Publication No. Sho 53-18866 discloses an electron gun in which an astigmatic lens is provided in a region between a second grid electrode and a third grid electrode forming a prefocus lens.

U.S. Pat. No. 3,952,224 and its corresponding Japanese Patent Laid-open No. Sho 51-64368 discloses an electron gun emitting three in-line electron beams in which an electron beam aperture of each of first and second grid electrodes is formed in an elliptic shape, and the degree of ellipticity of the aperture is made to differ for each beam path or the degree of ellipticity of the electron beam aperture of the center electron gun is made smaller than that of the side electron gun.

Japanese Patent Laid-open No. Sho 60-81736 discloses an electron gun emitting three in-line electron beams in which a slit recess provided in a third grid electrode on the cathode side forms a non-axially-symmetrical lens, and an electron beam is made to impinge on the phosphor screen through at least one non-axially-symmetrical lens in which the axial depth of the slit recess is larger for the center beam than for the side beam.

Japanese Patent Laid-open No. Sho 54-139372 discloses a color cathode ray tube having an electron gun emitting three in-line electron beams in which a soft magnetic material is disposed in fringe portions of the deflection magnetic field to form a pincushion-shaped magnetic field for deflecting the electron beams in the direction perpendicular to the in-line direction of each electron beam, thereby suppressing a halo caused by the deflection magnetic field in the direction perpendicular to the in-line direction.

The desired focus characteristics of a cathode ray tube include good resolution over the entire screen and over the entire, electron beam current region; no appearance of moire in a small-current region; and uniformity in resolution over the entire screen and over the entire electron beam current region. The design of an electron gun for simultaneously satisfying these focus characteristics requires a high technique.

The present inventors found that a combination of an astigmatic lens and a large-diameter main lens is essential to obtain these focus characteristics of the cathode ray tube.

In the above-described prior art, however, a dynamic focus voltage needs to be applied to a focus electrode of an electron gun for obtaining good resolution over the entire screen using electrodes forming an astigmatic lens, that is, a non-axially-symmetrical lens in the electron gun. No consideration has been given to correction of deflection defocusing by forming a uniform magnetic field by disposing magnetic pieces in a magnetic deflection field.

FIG. 24 is a partial sectional view of one example of an electron gun used for a cathode ray tube.

The electron gun of this type comprises a plurality of electrodes including a cathode K, a first grid electrode (G1) 1, a second grid electrode (G2) 2, a third grid electrode (G3) 3, a fourth grid electrode (G4) 4, a fifth grid electrode (G5) 5, a sixth grid electrode (G6) 6, and a shield cup 30 integrally attached to the sixth electrode (G6) 6. The fifth grid electrode (G5) 5 is composed of two electrodes 51 and 52.

A focus voltage is applied to the third grid electrode 3 and the first electrode 5, and an anode voltage is applied to the sixth electrode 6, so that an electron beam produced by a triode portion composed of the cathode K, the first grid electrode 1 and the second grid electrode 2 is accelerated and focused by an electron lens formed by the third grid electrode 3 to the sixth grid electrode 6, to project toward a phosphor screen.

Effects on an electron beam of electric fields determined by lengths of, and diameters of electron beam apertures in electrodes of this electron gun differ from electrode to electrode. For example, the shape of the electron beam aperture in the first grid electrode near the cathode K exerts an effect on the spot shape of an electron beam in a small-current region; however, the shape of the electron beam aperture in the second grid electrode exerts an effect on the spot shape of an electron beam in a wide current region from the small-current region to the large-current region.

In the electron gun in which a main lens is formed between the fifth grid electrode 5 and the sixth grid electrode 6 by applying an anode voltage to the sixth grid electrode 6, the shape of the electron beam aperture in each of the fifth grid electrode 5 and the sixth grid electrode 6 forming the main lens exerts a large effect on the shape of electron beam in a large-current region but exerts a smaller effect on the shape of the electron beam in a small-current region than in the large-current region.

The axial length of the fourth grid electrode 4 of the electron gun exerts an effect on the magnitude of the optimum focus voltage and also exerts a large effect on a difference in the optimum focus voltage between a small-current region and a large-current region. The effect of the axial length of the fifth grid electrode 5, however, is significantly smaller than that of the fourth grid electrode 4.

Accordingly, it is required in optimization of each characteristic of an electron beam to optimize the structure of an electrode most effective to the characteristic of the electron beam.

If a shadow mask aperture pitch in the direction perpendicular to the electron beam scanning direction is made smaller or the density of electron beam scanning lines is increased for enhancing resolution in the direction perpendicular to the electron beam scanning direction of a cathode ray tube, an optical interference occurs between electron beam scanning lines and the shadow mask apertures particularly in the electron beam small-current region, and accordingly moire contrast must be suppressed. The prior art, however, fails to solve the above-described problems.

For example, FIGS. 25A and 25B are schematic sectional views each having an essential portion of an electron gun, for comparing the two structures of the electron guns depending on the manner of supplying the focus voltage. FIG. 25A shows a fixed-focus-voltage type electron gun, and FIG. 25B shows a dynamic-focus-voltage type electron gun.

The configuration of the electron gun of the fixed-focus-voltage type shown in FIG. 25A is the same as that shown in FIG. 24, and therefore, parts corresponding to those in FIG. 24 are indicated by the same characters as in FIG. 24.

In the electron gun of the fixed-focus-voltage type shown in FIG. 25A, a focus voltage Vf1 having the same potential is applied to the electrodes 51 and 52 forming the fifth grid electrode 5.

On the other hand, in the electron gun of the dynamic-focus-voltage type shown in FIG. 25B, different focus voltages are respectively supplied to the electrodes 51 and 52 forming the fifth grid electrode 5. In particular, a dynamic focus voltage dVf is supplied to the electrode 52.

In the electron gun of the dynamic-focus-voltage type shown in FIG. 25B, the electrode 52 has a portion extending in the electrode 51. This complicates the structure as compared with the electron gun shown in FIG. 25A, increases the cost of the parts and reduces the efficiency in the assembling process.

FIGS. 26A and 26B are illustrations of waveforms of focus voltages respectively supplied to the electron guns shown in FIGS. 25A and 25B. FIG. 26A shows a focus voltage supplied to the electron gun of the fixed-focus-voltage type and FIG. 26B shows the focus voltage supplied to the electron gun of the dynamic-focus-voltage type.

Specifically, FIG. 26A shows that the fixed focus voltage Vf1 is applied to the third grid electrode 3 and the fifth grid electrode 5 (51, 52), and FIG. 26B shows that the fixed focus voltage Vf1 is applied to the third electrode 3 and the electrode 51 of the fifth grid electrode 5 and a voltage having a waveform of another fixed focus voltage Vf2 superposed with the dynamic focus voltage dvf is applied to the electrode 52 of the fifth grid electrode 5.

As a result, the electron gun of the dynamic-focus-voltage type shown in FIG. 25B requires two stem pins for supplying the focus voltages, and thereby it requires more consideration to high-voltage insulation of the two focus stem pins from the other stem pins as compared with the electron gun of the fixed-focus-voltage type shown in FIG. 25A.

Accordingly, the dynamic-focus-voltage type electron gun requires a specially structured socket for a cathode ray tube in a TV receiver set and a terminal display system, and further it requires a dynamic-focus-voltage generating circuit in addition to the two fixed-focus-voltage power supplies. This causes a disadvantage that it takes a lot of time for adjusting two focus voltages in the assembly line of TV receivers and display terminals.

In a cathode ray tube, the maximum deflection angle (hereinafter referred to as "deflection angle" or "deflection amount") is substantially in a specified range, and accordingly, as the size of a phosphor screen is increased, a distance between the phosphor screen and a main focus lens of an electron gun is increased, as a result of which mutual space-charge repulsion of electrons in such a space aggravates deterioration of focus characteristics.

Accordingly, resolution of a cathode ray tube can be improved by reducing degradation of the focus characteristic caused by space-charge repulsion thereby obtaining a small electron beam spot as in a small size phosphor screen.

The overall length of a cathode ray tube can be shortened by increasing a deflection angle. The depth of the existing TV receiver set (hereinafter referred to as "TV set") is dependent on the overall length of the cathode ray tube, and it is desirable to be short as much as possible because the TV set is regarded as furniture. Shortening of the depth of a TV set is also advantageous in transportation efficiency at the time when a TV set maker transports a large number of TV sets.

SUMMARY OF THE INVENTION

An object of the present invention is to solve the above-described problems of the prior art, and to provide a cathode ray tube employing an electron gun which is capable of improving focus characteristics and providing good resolution over the entire screen and over the entire electron beam current region, particularly, without dynamic focusing, and which is also capable of reducing moire in a small-current region.

To achieve the above object, according to the preferred embodiment of the present invention, there is provided a cathode ray tube including a phosphor screen, an electron gun comprising a plurality of electrodes, and a deflection device, wherein magnetic pieces attached to one of said plurality of electrodes and disposed in a magnetic deflection field generated by said deflection device are configured such that a magnetic field distribution having a region of a uniform magnetic field with an axial boundary thereof varying with a distance thereof from a tube axis is established to correct a deflection defocusing.

BRIEF DESCRIPTION OF THE DRAWINGS

In the drawings, which form an integral part of the specification and are to be read in conjunction therewith, and in which like reference numerals designate similar components throughout the figures, and in which:

FIG. 7A is a front view showing another example of a deflection defocusing correcting magnetic member used for the cathode ray tube of the present invention; FIG. 7B is a sectional view taken on line VIIB—VIIB of FIG. 7A; and FIG. 7C is a sectional view taken on line VIIC—VIIC of FIG. 7A;

FIG. 8A is a front view showing a further example of a deflection defocusing correcting magnetic member used for the cathode ray tube of the present invention; FIG. 8B is a sectional view taken on line VIIIB—VIIIB of FIG. 8A; and FIG. 8C is a sectional view taken on line VIIIC—VIIIC of FIG. 8A;

FIG. 9A is a front view showing a further example of a deflection defocusing correcting magnetic member used for the cathode ray tube of the present invention; FIG. 9B is a sectional view taken on line IXB—IXB of FIG. 9A; and FIG. 9C is a sectional view taken on line IXC—IXC of FIG. 9A;

FIG. 10A is a front view showing a further example of a deflection defocusing correcting magnetic member used for the cathode ray tube of the present invention; FIG. 10B is a sectional view taken on line XB—XB of FIG. 10A; and FIG. 10C is a sectional view taken on line XC—XC of FIG. 10A;

FIG. 11A is a front view showing a further example of a deflection defocusing correcting magnetic member used for the cathode ray tube of the present invention; FIG. 11B is a sectional view taken on line XIB—XIB of FIG. 11A; and FIG. 11C is a sectional view taken on line XIC—XIC of FIG. 11A;

FIG. 12A is a front view showing a further example of a deflection defocusing correcting magnetic member used for the cathode ray tube of the present invention; FIG. 12B is a sectional view taken on line XIIB—XIIB of FIG. 12A; and FIG. 12C is a sectional view taken on line XIIC—XIIC of FIG. 12A;

FIG. 13A is a front view showing a further example of a deflection defocusing correcting magnetic member used for the cathode ray tube of the present invention; FIG. 13B is a sectional view taken on line XIIIB—XIIIB of FIG. 13A; and FIG. 13C is a sectional view taken on line XIIIC—XIIIC of FIG. 13A;

FIG. 14A is a front view showing a further example of a deflection defocusing correcting magnetic member used for the cathode ray tube of the present invention; FIG. 14B is a sectional view taken on line XIVB—XIVB of FIG. 14A; and FIG. 14C is a sectional view taken on line XIVC—XIVC of FIG. 14A;

FIG. 15A is a front view showing a further example of a deflection defocusing correcting magnetic member used for the cathode ray tube of the present invention; FIG. 15B is a sectional view taken on line XVB—XVB of FIG. 15A; and FIG. 15C is a sectional view taken on line XVC—XVC of FIG. 15A;

FIG. 16A is a front view showing a further example of a deflection defocusing correcting magnetic member used for the cathode ray tube of the present invention; FIG. 16B is a sectional view taken on line XVIB—XVIB of FIG. 16A; and FIG. 16C is a sectional view taken on line XVIC—XVIC of FIG. 16A;

FIG. 17A is a front view showing a further example of deflection defocusing correcting magnetic member used for he cathode ray tube of the present invention; FIG. 17B is a sectional view taken on line XVIIB—XVIIB of FIG. 17A; and FIG. 17C is a sectional view taken on line XVIIC—XVIIC of FIG. 17A;

FIG. 18A is a front view showing a further example of a deflection defocusing correcting magnetic member used for the cathode ray tube of the present invention; FIG. 18B is a sectional view taken on line XVIIIB—XVIIIB of FIG. 18A; and FIG. 18C is a sectional view taken on line XVIIIC—XVIIIC of FIG. 18A;

FIGS. 19A and 19B are views illustrating a deflection magnetic field distribution on a tube axis of a cathode ray tube having a deflection angle of 100° or more, wherein FIG. 19A is the deflection magnetic field distribution, and FIG. 19B shows a positional relationship between the distribution and a deflection device;

FIGS. 20A and 20B are views illustrating a deflection magnetic field distribution on a tube axis of a cathode ray tube having a deflection angle less than 100°, wherein FIG. 20A is the deflection magnetic field distribution, and FIG. 20B shows a positional relationship between the distribution and a deflection device;

DETAILED DESCRIPTION OF THE PREFERRED EMBODIMENTS

Hereinafter, embodiments of the present invention will be described in detail with reference to the accompanying drawings. In a cathode ray tube, as described above, the amount of deflection defocusing increases rapidly with an increasing deflection amount of an electron beam.

According to the present invention, uniformity of resolution on the phosphor screen is improved by focusing the electron beam appropriately as the electron beam is deflected and changes its trajectory in a magnetic deflection field by establishing a magnetic field distribution for exerting a focusing or diverging force on the electron beam corresponding to a beam deflection amount and having a region of a uniform magnetic field with an axial boundary thereof varying with a distance thereof from a tube axis is established to exert a suitable focusing action on an electron beam. As a result, it is possible to improve uniformity of resolution on a phosphor screen.

According to the present invention, a magnetic field distribution having a region of a uniform magnetic field with an axial boundary thereof varying with a distance thereof from a tube axis is established to correct deflection defocusing rapidly increasing correspondingly to the amount of deflection of an electron beam when the electron beam is deflected and changes its trajectory in a magnetic deflection field, thereby focusing the electron beam appropriately over the entire phosphor screen. As a result, it is possible to improve uniformity of resolution over the entire phosphor screen.

An example of a magnetic field distribution for increasing a diverging force on an electron beam properly correspondingly to a beam deflection amount is obtained by establishing a pair of magnetic field distributions having a region of a uniform magnetic field with an axial boundary thereof varying with a distance thereof from a tube axis, substantially symmetrically on opposite sides of the trajectory of the undeflected electron beam.

A magnetic field distribution having a region of a uniform magnetic field corresponding to a magnetic deflection field strength with an axial boundary of the region varying with a distance thereof from a tube axis, established substantially symmetrically on opposite sides of the trajectory of the undeflected electron beam increases a diverging amount of the electron beam with increasing deflection of the electron beam.

Figures 1A, 1B:
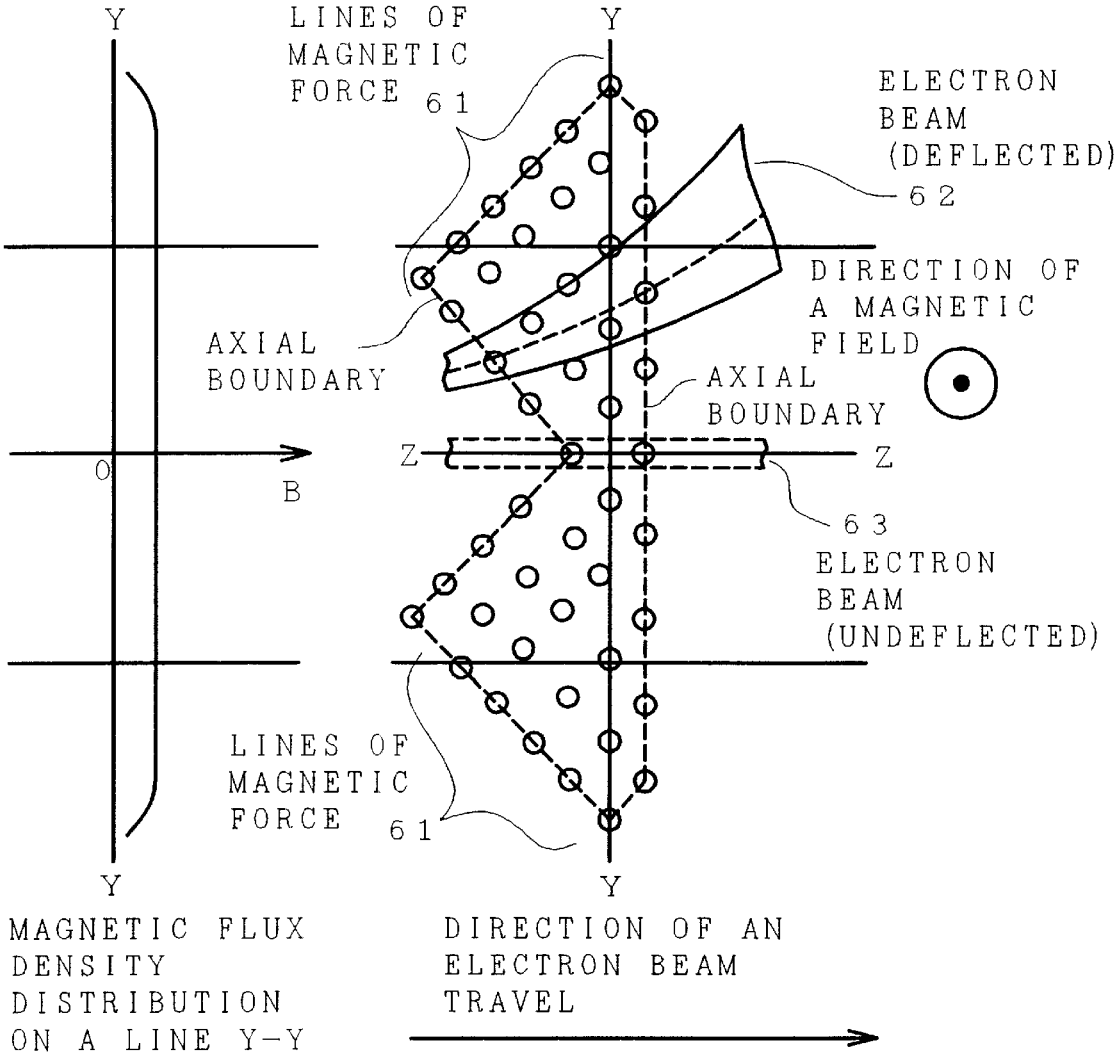
FIG. 1A is a schematic sectional view illustrating a first embodiment of a cathode ray tube of the present invention and FIG. 1B is a magnetic flux density distribution diagram thereof.

FIGS. 1A and 1B are schematic views illustrating a first embodiment of a cathode ray tube of the present invention, which show in cross-section an example of a pair of magnetic field distributions for exerting a diverging force on an electron beam corresponding to a magnetic deflection field and having a region of a uniform magnetic field with an axial (in the Z-Z direction) boundary thereof varying with a distance thereof from a tube axis, substantially symmetrically on opposite sides of the trajectory of the undeflected electron beam.

In FIG. 1A, reference numeral 61 indicates lines of magnetic force; 62 is a deflected electron beam traversing a region away from the center of a trajectory of an undeflected electron beam; and 63 is a trajectory of the undeflected electron beam. For the undeflected electron beam on the trajectory 63, there does not exist a beam-diverging magnetic field distribution having a region of a uniform magnetic field corresponding to a magnetic deflection field with an axial boundary thereof varying with a distance thereof from a tube axis, and thereby it is not subjected to the diverging force unlike the electron beam 62.

The deflected electron beam 62, which traverses away from the center of the trajectory of the undeflected electron beam, diverges more greatly than the undeflected electron beam 63 during the travel in a magnetic field, and the bundle of electron beams also moves away from the center of the trajectory of the undeflected electron beam. Also, the rate of change in trajectory is larger on the side of the deflected electron beam remote from the center of the trajectory of the undeflected electron beam. The reason for this is that as the electron beam moves away from the center of the trajectory of the undeflected electron beam, an axial extent of the region of the uniform magnetic field produced by lines of magnetic force 61 in the trajectory of the electron beam becomes longer.

By establishing such a magnetic field distribution having a region of a uniform magnetic field with an axial boundary thereof varying with a distance thereof from a tube axis in a deflection magnetic field, when an electron beam is deflected and changes its trajectory in a deflection magnetic field, the diverging force exerted on the electron beam is increased correspondingly to the amount of deflection, to thereby correct the deflection defocusing caused by the increasing strength of the focusing action on the electron beam.

Figure 27:
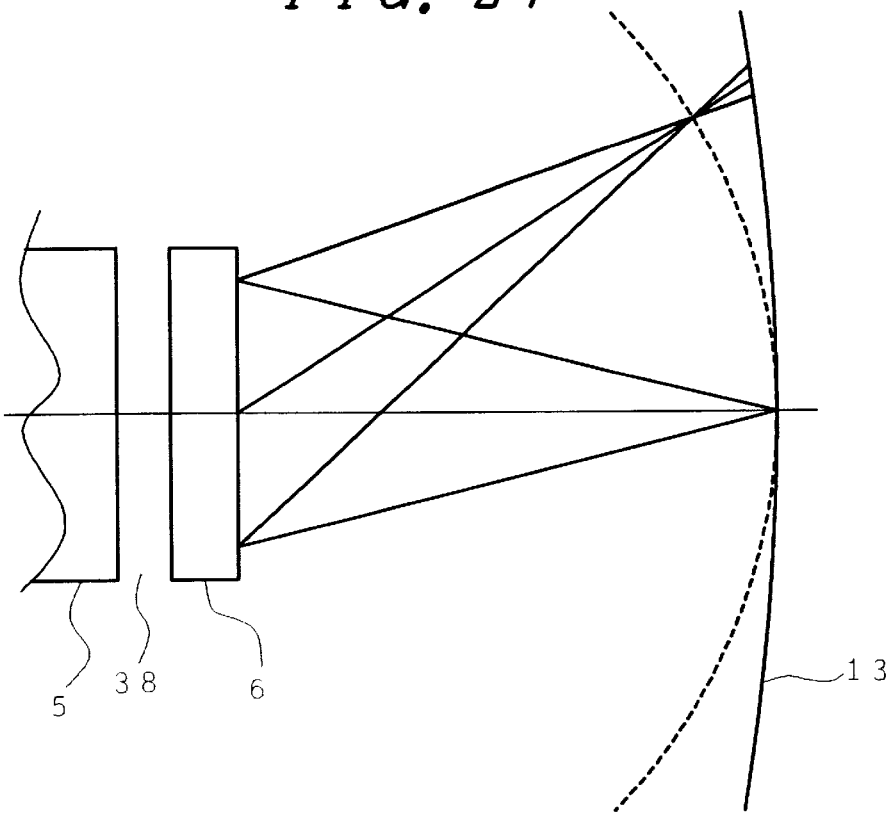
FIG. 27 is a view illustrating focusing conditions of electron beams on a phosphor screen.

For example, as shown in FIG. 27, in a cathode ray tube, a distance between a main lens of an electron gun to the center of a phosphor screen is generally longer than a distance between the main lens to the periphery of the phosphor screen, and accordingly, even in the case where a deflection magnetic field has no focusing action on the electron beam, when an electron beam is adjusted for optimum focus at the center of the phosphor screen, the electron beam is overfocused at the periphery of the phosphor screen.

In this embodiment, as shown in FIG. 1A, a magnetic field distribution having a region of a uniform magnetic field corresponding to a beam deflection amount with an axial boundary thereof varying with a distance thereof from a tube axis is established in a deflection magnetic field, to increase a diverging force correspondingly to an increasing amount of deflection, thereby correcting deflection defocusing.

An example of a magnetic field distribution for increasing a diversing force on an electron beam properly correspondingly to a beam deflection amount is obtained by establishing a magnetic field distribution having a region of a uniform magnetic field corresponding to a beam deflection amount with an axial boundary thereof varying with a distance thereof from a tube axis, symmetrically with respect to the center of the trajectory of the undeflected electron beam.

A magnetic field distribution having a region of a uniform magnetic field corresponding to a magnetic deflection field strength with an axial boundary of the region varying with a distance thereof from a tube axis, established symmetrically with respect to the center of the trajectory of the undeflected electron beam increases the diversing amount of the electron beam with increasing deflection of the electron beam.

Figure 2B:
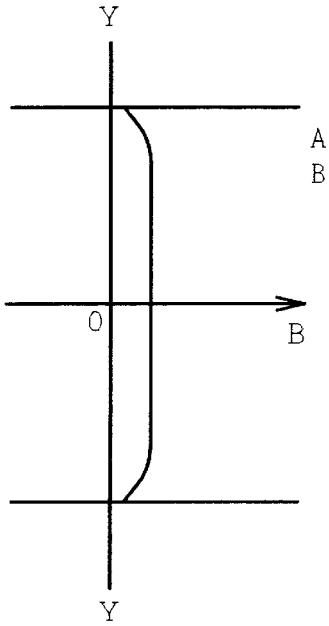
FIG. 2A is a schematic sectional view illustrating a second embodiment of the present invention and FIG. 2B is a magnetic flux density distribution diagram thereof.
Figure 2A:
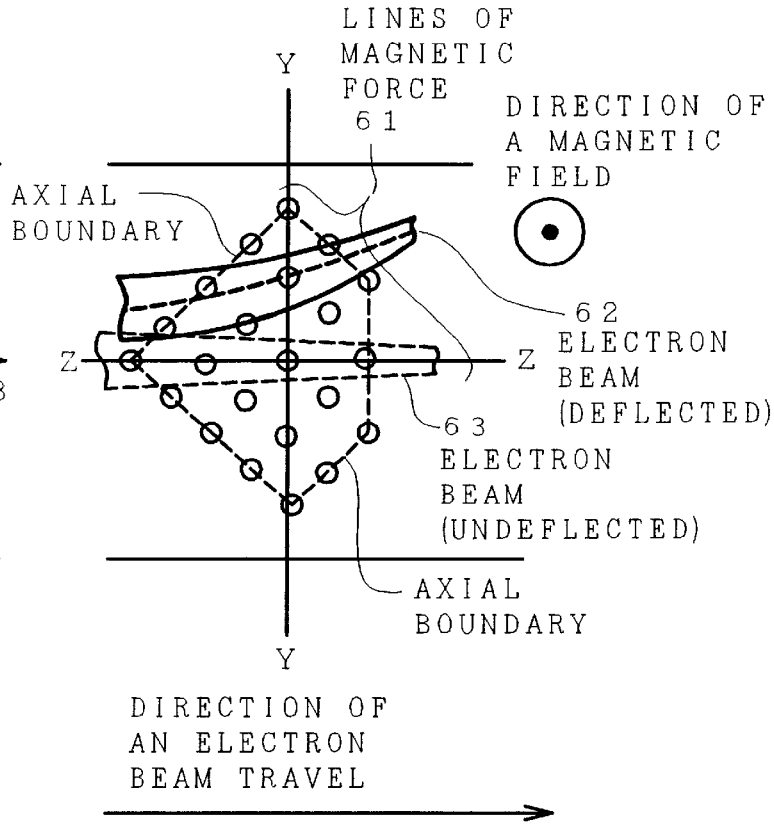

FIGS. 2A and 2B are schematic views illustrating a second embodiment of a cathode ray tube of the present invention, which show in cross-section an example of a magnetic field distribution for exerting a focusing force on an electron beam corresponding to a magnetic deflection field and having a region of a uniform magnetic field with a axial boundary thereof varying with a distance thereof from a tube axis, symmetrically with respect to the center of the trajectory of the undeflected electron beam.

In FIG. 2A, reference numeral 61 indicates lines of magnetic force for establishing a magnetic field distribution having a region of a uniform magnetic field corresponding to a magnetic deflection field strength with an axial boundary of the region varying with a distance thereof from a tube axis; and 62 is a deflected electron beam traversing a region away from the center trajectory Z-Z of an undeflected electron beam. An undeflected electron beam 63 is shown by a broken line as in FIG. 1A.

The electron beam 62, which traverses a region away from the center trajectory of the undeflected electron beam 63, is focused more strongly than the undeflected electron beam 63 while traveling in the magnetic field, and the bundle of the electron beams 62 moves away from the center trajectory of the undeflected electron beam 63. Further, for the electron beams 63, the rate of change in trajectory is smaller on the side of the electron beams 62 remote from the center trajectory of the undeflected electron beam 63. The reason for this is that an axial extent of the region having a uniform magnetic field produced by lines of magnetic force 61 becomes shorter as the electron beam becomes more remote from the center trajectory Z-Z of the undeflected electron beam in a region traversed by the electron beam By establishing such a magnetic field distribution having a region of a uniform magnetic field with an axial boundary of the region varying with a distance thereof from a tube axis in a deflection magnetic field, when an electron beam is deflected and changes its trajectory, the focusing force exerted on the electron beam is increased correspondingly to the amount of deflection, to thereby correct the deflection defocusing caused by the increasing divergence of the electron beam.

Figure 28:
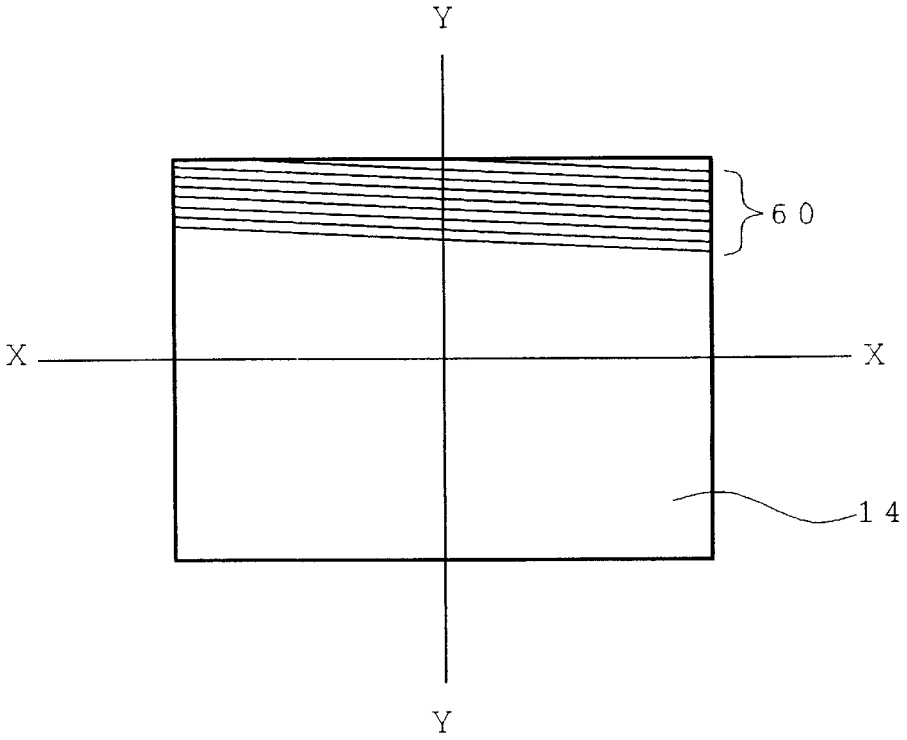
FIG. 28 is a view illustrating scanning lines formed on a panel portion forming a phosphor screen of a cathode ray tube.

The beam deflection for a cathode ray tube is generally performed by scanning electron beams linearly as shown in FIG. 28. The linear scanning locus 60 is called a scanning line. In many cases, a deflection magnetic field differs between in the direction of the scanning line and in the direction perpendicular to the scanning line.

Further, in many cases, an electron beam is subjected to a focusing action which differs in strength between in the direction of the scanning line and in the direction perpendicular to the scanning line and is exerted by at least one of a plurality of electrodes of an electron gun, before being strongly influenced by a magnetic field distribution having a region of a uniform magnetic field corresponding to a magnetic deflection field strength with a axial boundary of the region varying with a distance thereof from a tube axis, established in a deflection magnetic field.

Importance is attached to the deflection defocusing correction in the direction of the scanning line or in the direction perpendicular to the scanning line depending on the application use of a cathode ray tube.

Accordingly, it is not possible to uniquely determine a magnetic field distribution having a region a uniform magnetic field corresponding to a magnetic deflection field strength with an axial boundary of the region varying with a distance thereof from a tube axis, to be established in a deflection magnetic field for correcting the deflection defocusing and improving uniformity of resolution over the entire phosphor screen.

The techniques and the necessary cost vary depending on the direction with respect to the beam scanning line of and the amount of a deflection defocusing to be corrected, and therefore, it is important for improving characteristics of an image display device and realizing the low cost thereof to determine the direction and the amount of deflection defocusing to be corrected for each case.

A third embodiment of a cathode ray tube of the present invention is intended to form a uniform magnetic field shown in FIGS. 1A, 1B and FIGS. 2A, 2B in a deflection magnetic field for correcting deflection defocusing in the direction of the scanning lines and/or in the direction perpendicular to the scanning lines.

Figure 23:
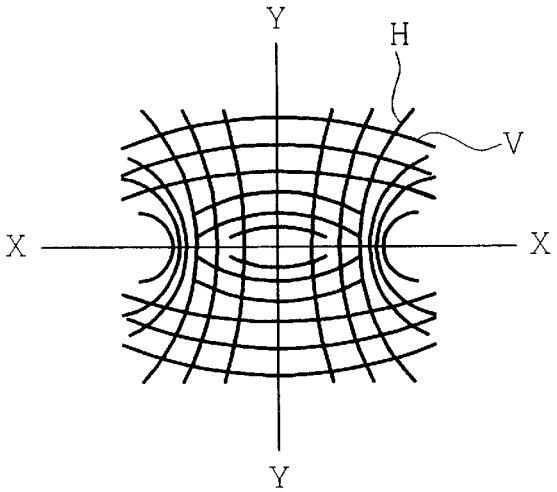
FIG. 23 is a diagram illustrating a magnetic deflection field distribution.
Figure 24:
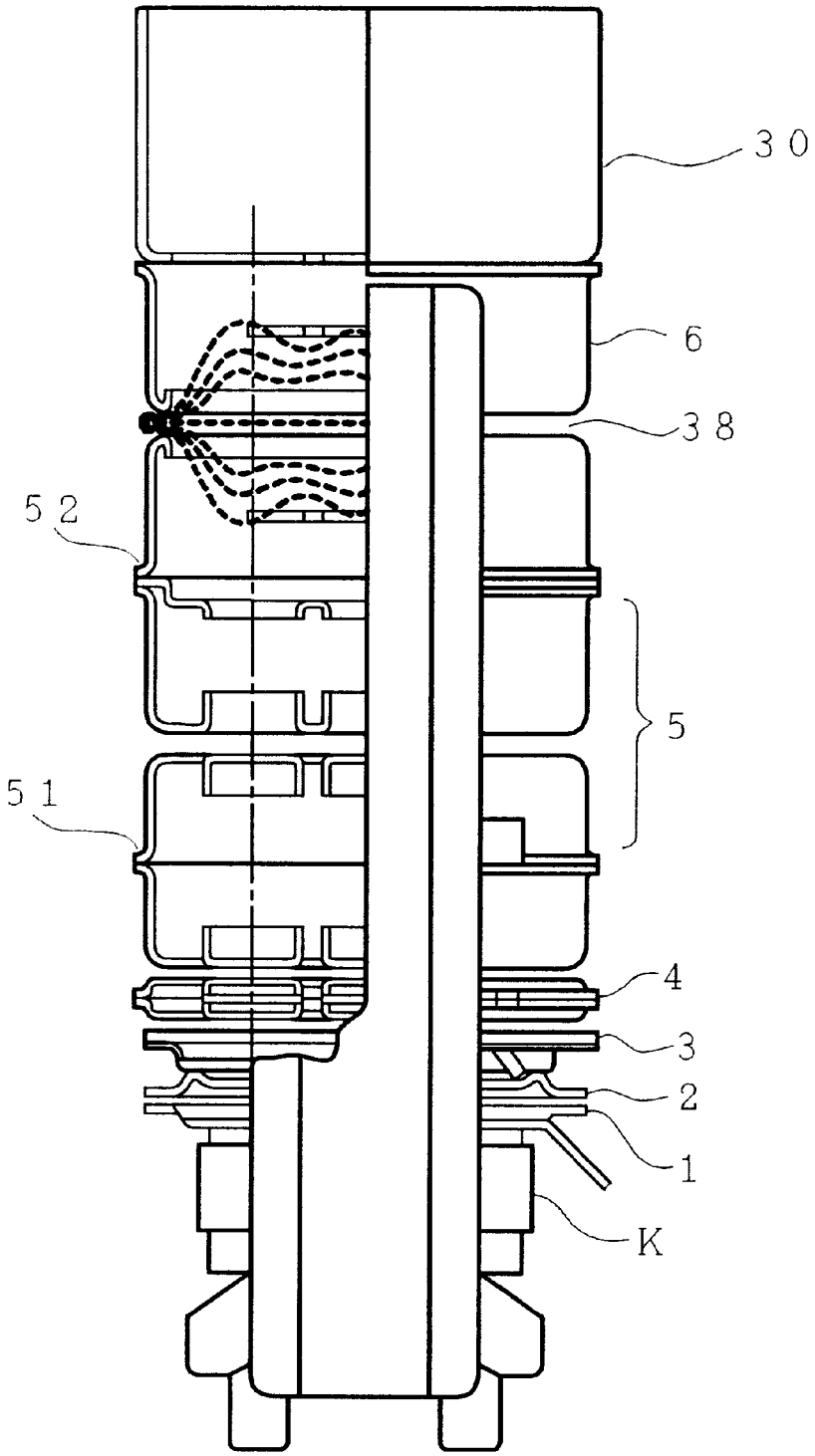
FIG. 24 is a side view with components partially cutaway, illustrating one example of an electron gun used for a cathode ray tube.
Figure 25A:
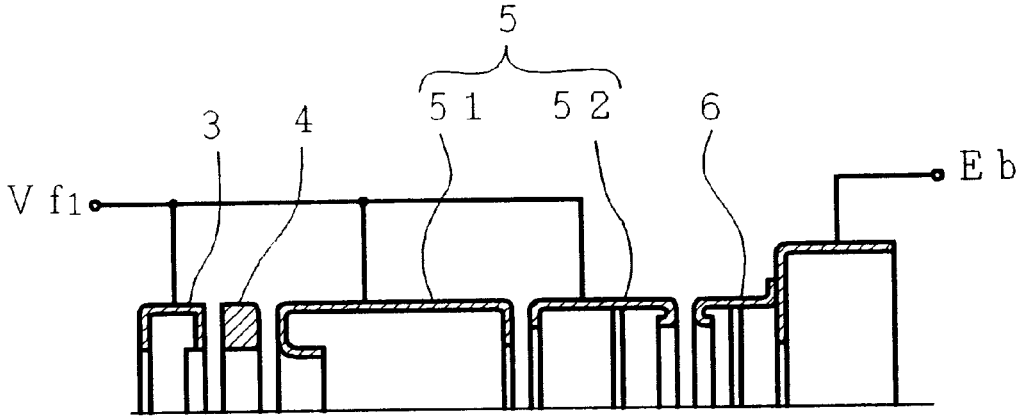
FIGS. 25A and 25B are schematic sectional views of essential portions for comparing structures of two electron guns with each other in terms of the manner of applying focus voltages.
Figure 25B:
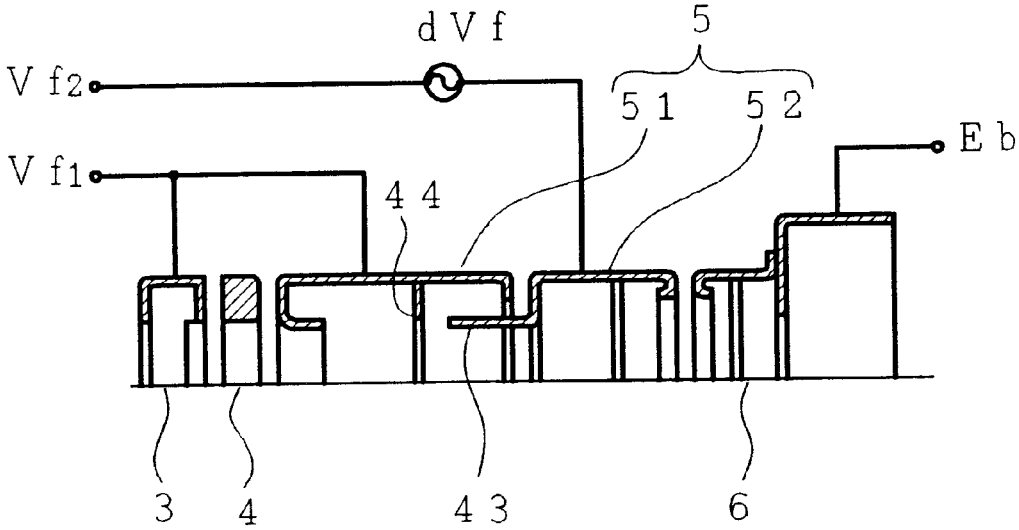

In a color cathode ray tube generating three electron beams in a horizontal line, a barrel-shaped magnetic field distribution is used for a vertical deflection magnetic field and a pincushion-shaped magnetic field distribution is used for a horizontal deflection magnetic field as shown in FIG. 23 in order to simplify a circuit for controlling convergence of three electron beams on the phosphor screen.

For each of side beams of three in-line electron beams, the amount of deflection defocusing due to a vertical 20 deflection magnetic field is dependent on the strength of the vertical deflection magnetic field and on which of the left and right sides of the screen the electron beam is deflected to. For example, the amount of deflection defocusing of an electron beam emitted from the electron gun on the right-hand side of the in-line direction viewed from the phosphor side differs between a case where it is deflected to the left side of the phosphor screen and a case where it is deflected o the right side, because the two magnetic field distributions of the deflection magnetic field traversed by the two electron beams respectively are different from each other, with a result that the image quality differs between the right and left sides of a display reproduced by the same electron gun on the phosphor screen.

To correct deflection defocusing of side electron beams in such a case, it is effective to establish a magnetic field distribution having a region of a uniform magnetic field corresponding to a magnetic deflection field strength with an axial boundary of the region varying with a distance thereof from a tube axis, asymmetrically with respect to the center axis of a side electron gun in the direction of the horizontal deflection in the magnetic deflection field.

FIGS. 3A to 3D are schematic views illustrating a fourth embodiment of the present invention, which show an example of two different magnetic field distributions for diverging an electron beam having a region of a uniform magnetic field with an axial boundary of the region varying with a distance thereof from a tube axis established on opposite sides of the center of the electron gun, respectively.

Figure 3B:
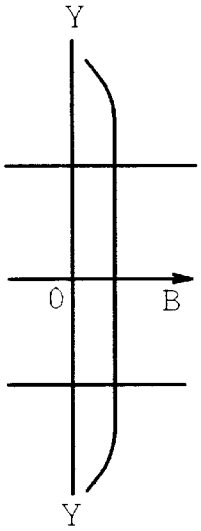
FIGS. 3B and 3D are magnetic flux density distribution diagrams thereof.
Figure 3A:
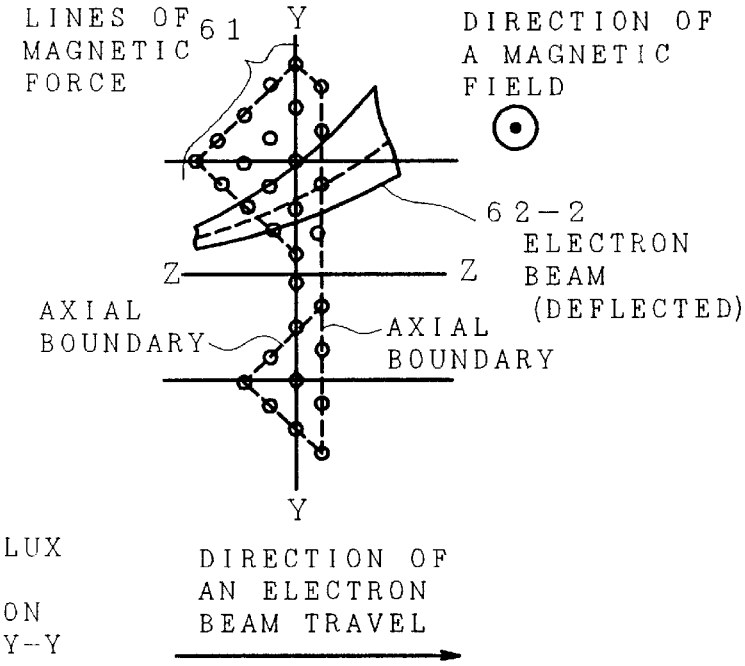
FIGS. 3A and 3C are schematic sectional views illustrating a fourth embodiment of the present invention.
Figure 3D:
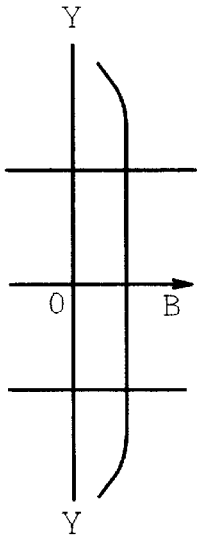
Figure 3C:
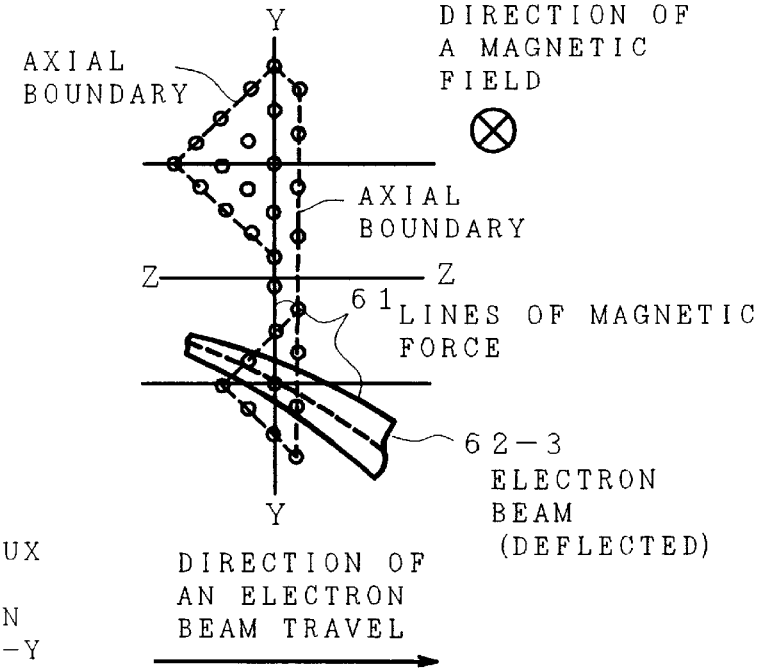

FIGS. 3A and 3B are schematic views illustrating the divergence of an electron beam on the side where the axial extents of the region of a uniform magnetic field are longer in a magnetic field distribution having a region of a uniform magnetic field with an axial boundary of the region varying with a distance thereof from a tube axis. As will be apparent from these figures, on the side where the axial extents of the region of a uniform magnetic field produced by lines of magnetic force 61 are longer in the magnetic field distribution, an electron beam 62-2 traversing a region away from the center axis Z-Z of the electron gun diverges while traveling in the magnetic field, and the bundle of the electron beams 62-2 moves away from the center axis Z-Z. The rate of change in trajectory is also larger on the side of the electron beam remote from the center axis Z-Z. The reason for this is that an axial extent of the region having a uniform magnetic field produced by lines of magnetic force 61 becomes longer in the range traversed by the electron beam as the electron beam moves away from the center axis Z-Z. FIGS. 3C and 3D are schematic views illustrating the divergence of an electron beam on the side where the axial extents of the region of a uniform magnetic field produced by lines of magnetic force 61 are shorter. Similarly to the above-explained electron beam 62-2, an electron beam 62-3 traversing a region away from the center axis Z-Z diverges while traveling in the magnetic field, and also the bundle of the electron beams 62-3 moves away from the center axis Z-Z. The rate of change in trajectory is larger on the side of the electron beam remote from the center axis Z-Z, however, it is smaller than that of the electron beam 62-2. This is because an axial extent of the region having a uniform magnetic field produced by lines of magnetic force 61 does not become so longer even at a region away from the center axis Z-Z in the region traversed by the electron beam.

If such a magnetic field distribution having a region of a uniform magnetic field corresponding to a magnetic deflection field strength with an axial boundary of the region varying with a distance thereof from a tube axis is established in a deflection magnetic field, the rate of increase of a diverging action exerted on a deflected electron beam correspondingly to the amount of deflection of an electron beam differs with directions of beam deflection, and it is possible to correct deflection defocusing which causes the focusing action on the electron beam differing in strength with directions of the beam deflection.

Actually, the above magnetic field distribution is not uniquely determined because it is dependent on the structure of a cathode ray tube including the maximum deflection angle used, the structure of a deflection magnetic field generating portion, pole pieces for forming the above uniform magnetic field, the structure of the electron gun except for the portion for forming the uniform magnetic field, operating conditions of the cathode ray tube, application use of the cathode ray tube and the like.

FIGS. 4A to 4D are schematic views illustrating a fifth embodiment of a cathode ray tube of the present invention, which show an example of a beam-focusing magnetic field distribution having a region of a uniform magnetic field with an axial boundary of the region varying with a distance thereof from a tube axis, disposed in a region near the center axis of the electron gun, and with its axis of symmetry off-center from the center axis of an electron gun. An electron beam 62-4 deflected and traversing a region away from the center axis Z-Z on the side where the axial extents of the region having a uniform magnetic field produced by lines of magnetic force 61 are longer in the magnetic field distribution is compared with an electron beam 62-5 deflected and traversing a region away from the center axis Z-Z on the side where the axial extents of the region having a uniform magnetic field produced by lines of magnetic force 61 are shorter in the magnetic field distribution.

The electron beam 62-4 on the side where the axial extents of the region having a uniform magnetic field are longer in the magnetic field distribution are focused while traveling in the magnetic field, and at the same time the bundle of the electron beams 62-4 moves away from the center axis Z-Z. Further, the rate of change in trajectory of the electron beam 62-4 is larger on the side of the electron beam 62-4 nearer the center axis Z-Z. This is because an axial extent of the region having a uniform magnetic field produced by lines of magnetic force 61 becomes shorter in a region traversed by the electron beam 62-4 as the electron beam 62-4 moves away from the center axis Z-Z.

The electron beam 62-5 traversing a region away from the center axis Z-Z on the side where the axial extents of the region having a uniform magnetic field are shorter in the magnetic field distribution, similarly to the electron beam 62-4, is focused while traveling in the magnetic field, and the at the same time the bundle of the electron beams 62-5 moves away from the center axis Z-Z. Further, the rate of change in trajectory of the electron beam is larger on the side of the electron beam 62-5 nearer the center axis Z-Z; however, it is smaller than that of the electron beam 62-4. This is because an axial extent of the region having a uniform magnetic field produced by lines of magnetic force 61 does not change so much with a distance from the center axis Z-Z.

In the case where such a magnetic field distribution having a region of a uniform magnetic field with an axial boundary of the region varying with a distance thereof from a tube axis is established in a deflection magnetic field, the rate of increase of a focusing action exerted on a deflected electron beam correspondingly to the amount of deflection of an electron beam differs with directions of the beam deflection, and it is possible to correct deflection defocusing which causes the diverging action on the electron beam differing in strength with directions of the beam deflection.

Actually, the above magnetic field distribution is not uniquely determined because it is dependent on the structure of a cathode ray tube including the maximum deflection angle used, the structure of a deflection magnetic field generating portion, pole pieces for forming the above uniform magnetic field, the structure of the electron gun except for the portions for forming the uniform magnetic field, operating conditions of the cathode ray tube, application use of the cathode ray tube and the like.

In a color cathode ray tube generating three in-line electron beams in a horizontal line, a barrel-shaped distribution of lines of magnetic force is used for a vertical deflection magnetic field and a pincushion-shaped distribution of lines of magnetic force is used for a horizontal deflection magnetic field as shown in FIG. 23, in order to simplify a circuit for controlling convergence of three electron beams on the phosphor screen.

In such a color cathode ray tube, the in-line direction, that is, the above horizontal direction is the direction of the scanning direction. For each of side electron beams of three in-line electron beams, the amount of deflection defocusing due to a vertical deflection magnetic field depends on both the strength of the vertical deflection magnetic field and the direction of horizontal deflection.

For example, the amount of deflection defocusing of an electron beam emitted from the electron gun on the right hand side of the in-line direction viewed from the phosphor side differs between a case where it is deflected to the left side of the phosphor screen and a case where it is deflected to the right side, because the two magnetic field distributions of the deflection magnetic field traversed by the two electron beams respectively are different from each other.

According to a further embodiment of the present invention, deflection defocusing is corrected by establishing within magnetic deflection fields for side electron beams among the three in-line beams, a magnetic field distribution having a region of a uniform magnetic field corresponding to a magnetic deflection field strength with an axial boundary of the region varying with a distance thereof from a tube axis, asymmetrical with respect to the axis of an electron gun in the direction of the scanning lines, as shown in FIGS. 3A to 3D or FIGS. 4A to 4D.

The above magnetic field distribution is dependent on the structure of a cathode ray tube including the maximum deflection angle used, the structure of a deflection magnetic field generating portion, pole pieces for forming the above uniform magnetic field, the structure of the electron gun except for the portion for forming the uniform magnetic field, operating conditions of the cathode ray tube, application use of the cathode ray tube and the like.

Figure 5B:
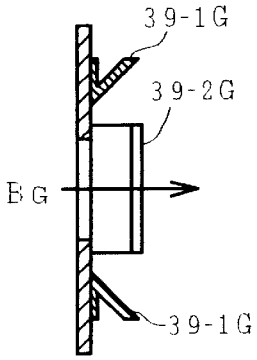
FIG. 5B is a sectional view taken on line VB—VB of FIG. 5A.
Figure 5A:
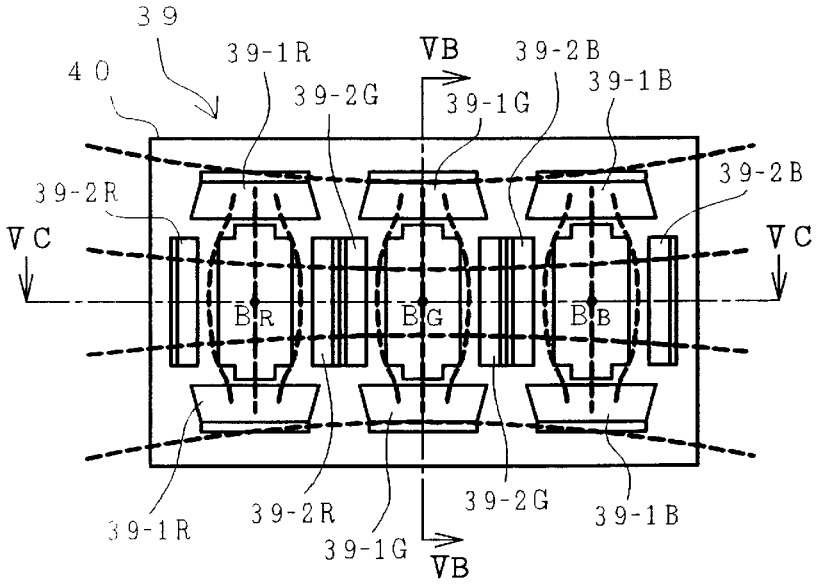
FIG. 5A is a front view showing one example of a deflection defocusing correcting magnetic member used for the cathode ray tube of the present invention.

FIG. 5A is a front view, seen from a cathode side, illustrating one example of a deflection defocusing correcting magnetic member used for a cathode ray tube of the present invention; FIG. 5B is a sectional view taken on line VB—VB of FIG. 5A; and FIG. 5C is a sectional view taken on line VC—VC of FIG. 5A.

Figure 5C:
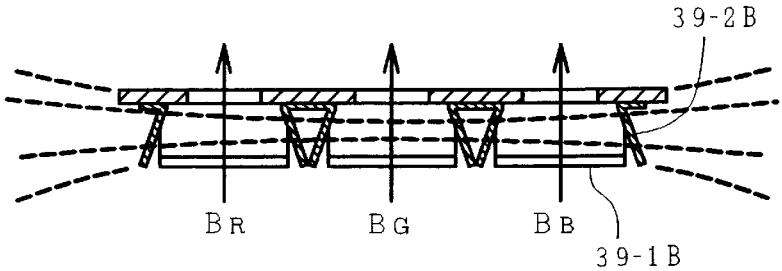
FIG. 5C is a sectional view taken on line VC—VC of FIG. 5A.

In FIGS. 5A to 5C, reference numeral 39 indicates a deflection defocusing correcting magnetic member; 39-1R, 39-1G, and 39-1B are vertical correcting pole pieces disposed above and below each of the electron beams BR, BG and BB; and 39-2R, 39-2G, and 39-2B are horizontal correcting pole pieces disposed on opposite sides of each of the electron beams BR, BG and BB.

In addition, reference numeral 40 indicates a base plate formed of a non-magnetic sheet such as stainless steel for supporting the pole pieces.

The use of the pole pieces having shapes shown in the figures makes it possible to establish, for each electron beam, a magnetic field distribution having a region of a uniform magnetic field corresponding to a magnetic deflection field strength with an axial boundary of the region varying with a distance thereof from a tube axis.

In addition, the shapes of the pole pieces shown in the figures are illustrative purposes only, and the pole pieces may be formed in shapes capable of modifying a magnetic deflection field into a magnetic field distribution having a region of a uniform magnetic field corresponding to a magnetic deflection field strength with an axial boundary of the region varying with a distance thereof from a tube axis.

Figure 6:
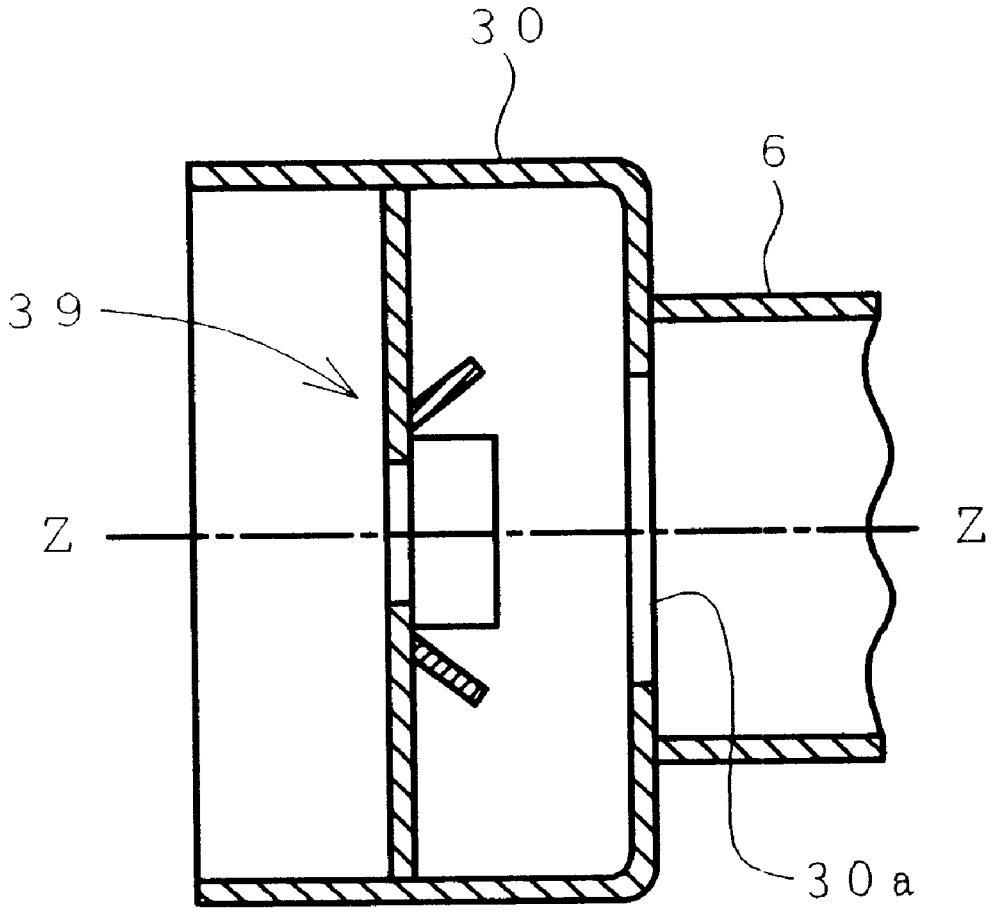
FIG. 6 is a sectional view of an essential portion of an example in which the deflection defocusing correcting magnetic member shown in FIGS. 5A to 5C is incorporated in an electron gun.

FIG. 6 is a sectional view showing an essential portion illustrating an example in which the deflection defocusing correcting magnetic member shown in FIGS. 5A to 5C is incorporated into an electron gun. Reference numeral 6 indicates a sixth electrode (anode), and 30 is a shield cup. The deflection defocusing correcting magnetic member 39 is disposed in the shield cup 30, and provides a magnetic field distribution having a region of a uniform magnetic field with an axial boundary of the region varying with a distance thereof from a tube axis, thereby correcting deflection defocusing. In addition, the shield cup 30 is provided with one electron beam aperture 30*a* for each of three electron beams or a single opening common to three electron beams.

FIG. 7A is a front view, seen from the phosphor screen side, illustrating another example of a deflection defocusing correcting magnetic member used for the cathode ray tube of the present invention; FIG. 7B is a sectional view taken on line VIIB—VIIB of FIG. 7A; and FIG. 7c is a sectional view taken on line VIIC—VIIC of FIG. 7A. Parts corresponding to those in FIGS. 5A to 5C are indicated by the same characters as in FIGS. 5A to 5C.

In this example, a deflection defocusing correcting magnetic member 39 includes three pairs 39R, 39G and 39B, of parallel pole pieces extending in the direction perpendicular to the in-line direction of the three beams. Each pair are disposed on opposite sides of each electron beam to form a homogeneous magnetic field corresponding to a vertical deflection magnetic field. These pole pieces 39R, 39G and 39B are formed of magnetic sheets cut and bent into such shapes that an area having a vertical deflection defocusing correcting magnetic field extends longer along the tube axis with an increasing distance from the tube axis.

By the use of the deflection defocusing correcting magnetic member 39, a magnetic field of diverging an electron beam in the vertical direction (perpendicular to the in-line direction) is established, so that the electron beam diverges in the vertical direction and is focused in the in-line direction when deflected to corners of the screen. Thus, a desired deflection defocusing correction can be achieved.

FIG. 8A is a front view, seen from the phosphor screen side, illustrating a further example of a deflection defocusing correcting magnetic member used for the cathode ray tube of the present invention; FIG. 8B is a sectional view taken on line VIIIB—VIIIB of FIG. 8A, and FIG. 8C is a sectional view taken on line VIIIC—VIIIC of FIG. 8A. In FIGS. 8A to 8C, parts corresponding to those in FIGS. 7A to 7C are indicated by the same characters as in FIGS. 7A to 7C.

A deflection defocusing correcting magnetic member 39 in this example has the same basic configuration as that shown in FIGS. 7A to 7C, except that pole pieces are formed of blocks made of a magnetic material.

Figure 31A:
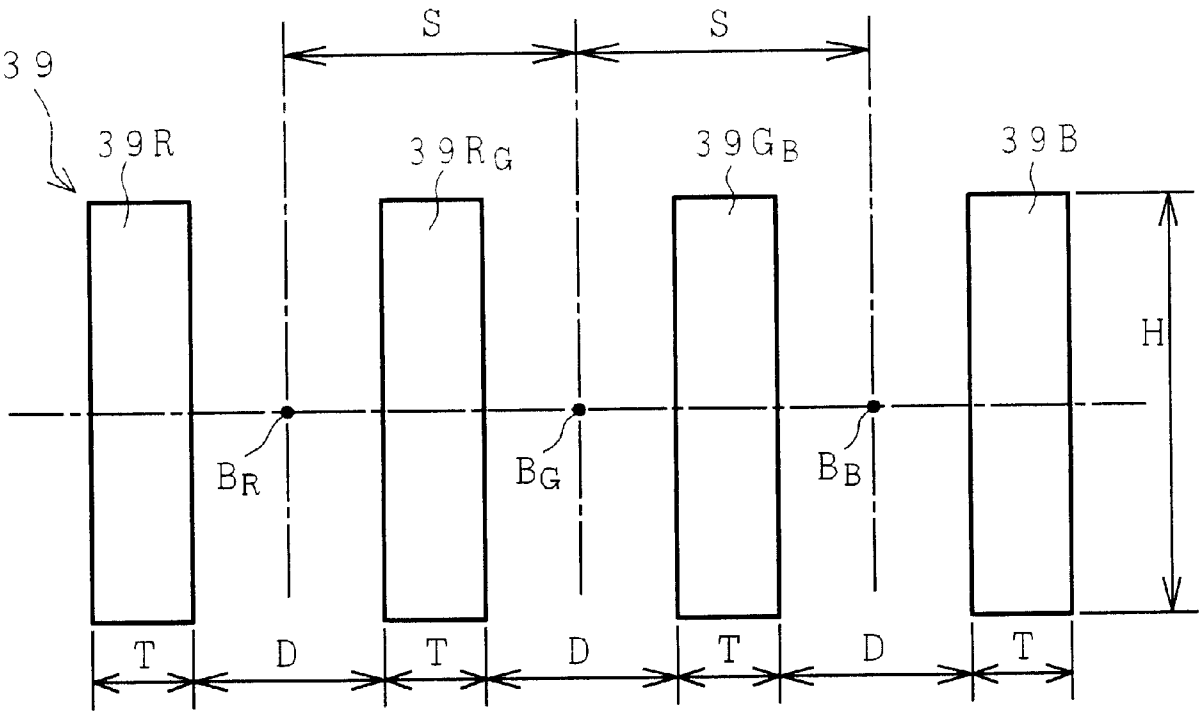
FIG. 31A is a front view showing a numerical example of the present invention.
Figure 31B:
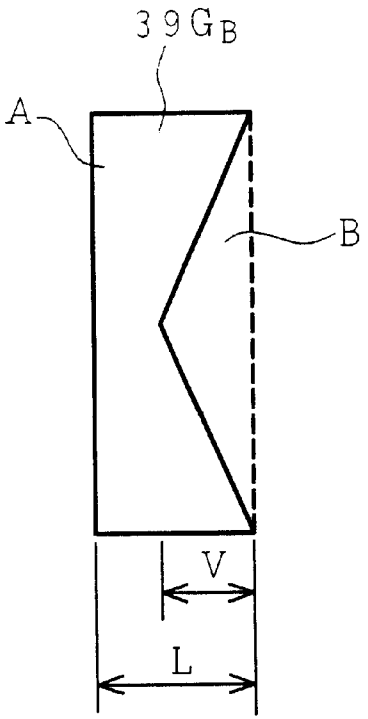
FIG. 31B is a side view thereof.

A concrete modification of the example shown in FIGS. 8A to 8C are shown in FIGS. 31A and 31B. FIGS. 31A is a front view and FIG. 31B is a side view. In FIG. 31A, a dimension S indicates a spacing in mm between two adjacent electron beams in a triode section of an electron gun. In these figures, other dimensions are as follows:

L=(0.19–2.8)S

D=(0.2–0.8)S

H=(0.37–2.8)S

V=(0.19–2.8)S

T=(0.25–0.8)S

L/D=0.23–13.7

H/D=0.47–13.7

(area A of a pole piece)/(area B of a cutout)=1–31.1

FIG. 9A is a front view, seen from the phosphor screen side, illustrating a further example of a deflection defocusing correcting magnetic member used for the cathode ray tube of the present invention; FIG. 9B is a sectional view taken on line IXB—IXB of FIG. 9A; and FIG. 9C is a sectional view taken on line IXC—IXC of FIG. 9A. In FIGS. 9A to 9C, parts corresponding to those in FIGS. 7A to 7c are indicated by the same characters as in FIGS. 7A to 7C.

A deflection defocusing correcting magnetic member 39 in this example has the same basic effects on the electron beam as that shown in FIGS. 7A to 7C, except that each of magnetic materials 39R, 39G and 39B forming pole pieces is formed into a shape concavely recessed in the axial direction as shown in the figures to provide a correcting magnetic field increasing rapidly with an increase in the amount of the beam deflection.

FIG. 10A is a front view, seen from the phosphor screen side, illustrating a further example of a deflection defocusing correcting magnetic member used for the cathode ray tube of the present invention; FIG. 10B is a sectional view taken on line XB—XB of FIG. 10A; and FIG. 10C is a sectional view taken on line XC—XC of FIG. 10A. In FIGS. 10A to 10C, parts corresponding to those in FIGS. 7A to 7C are indicated by the same characters as in FIGS. 7A to 7C.

In a deflection defocusing correcting magnetic member 39 in this example, the magnetic materials 39R, 39G and 39B forming the pole pieces are modifications of those in FIGS. 7A to 7c. Pole pieces associated with the center electron beam differ from those associated with the side electron beams. The length HC related to the center beam BG is made longer in the direction perpendicular to the in-line direction than the corresponding length HS related to the side beams BR, BB and the length ZC related to the center beam BG in the axial direction is made longer than the corresponding length ZS related to the side beams BR and BB. As a result, the rate of increase of the correction amount exerted on the center electron beam with the increase of the deflection amount is greater than that on the side electron beams.

FIG. 11A is a front view, seen from the phosphor screen side, illustrating a further example of a deflection defocusing correcting magnetic member used for the cathode ray tube of the present invention; FIG. 11B is a sectional view taken on line XIB—XIB of FIG. 11A, and FIG. 11C is a sectional view taken on line XIC—XIC of FIG. 11A. In FIGS. 11A to 11C, parts corresponding to those in FIGS. 7A to 7C are indicated by the same characters as in FIG. 7A to 7C.

A deflection defocusing correcting magnetic member 39 in this example includes three pairs 39R, 39G and 39B of parallel pole pieces extending in the direction perpendicular to the in-line direction. Each pole piece is formed in such a shape (trapezoidal shape in the FIG. 11B) as to form a homogeneous magnetic field corresponding to vertical deflection and to be shorter in length in the axial direction as with an increasing distance from the tube axis. By the use of the deflection defocusing correcting magnetic member 39, an electron beam is focused in both the vertical and horizontal directions when deflected to the corners of the screen.

Figure 32A:
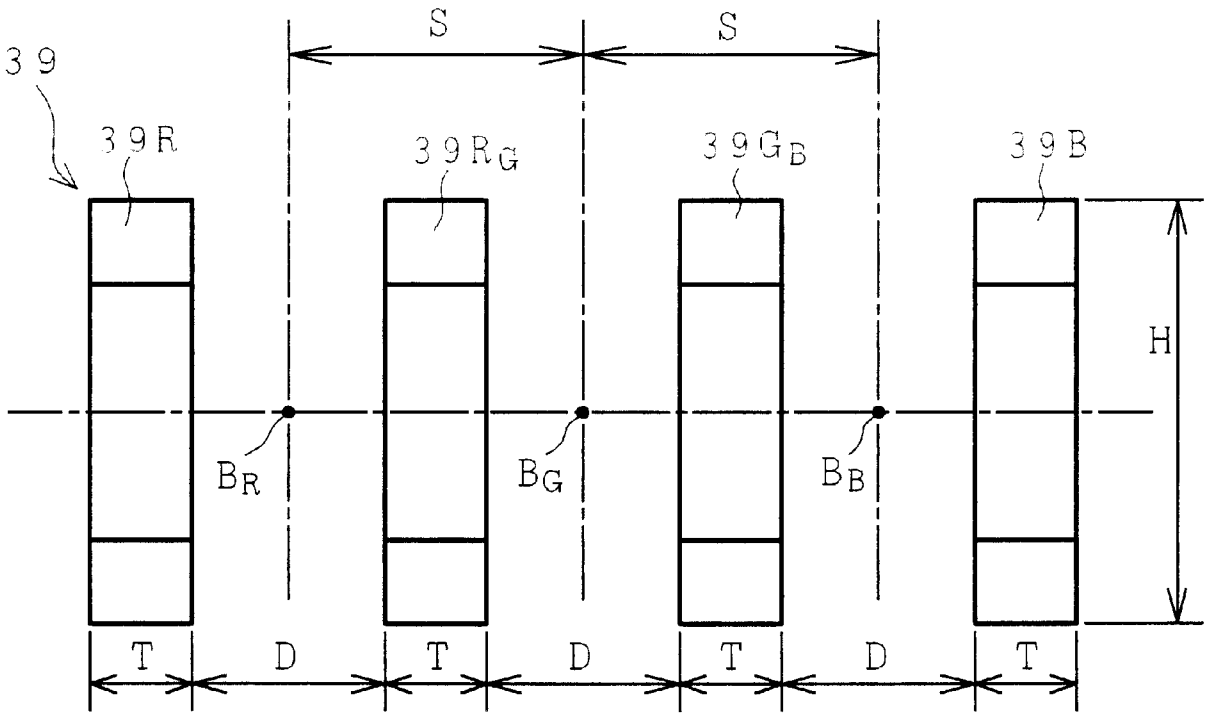
FIG. 32A is another numerical example of the present invention.
Figure 32B:
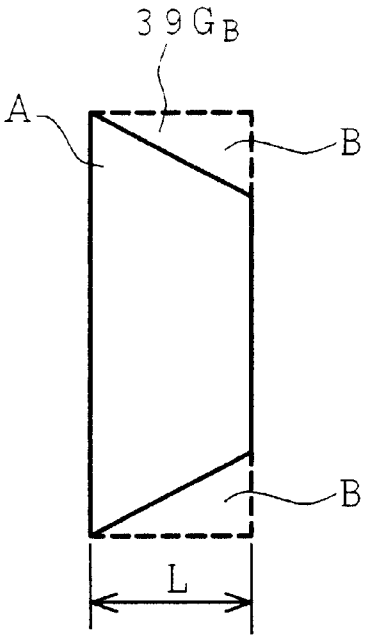
FIG. 32B is a side view thereof.

A concrete modification of the example shown in FIGS. 11A to 11C is shown in FIGS. 32A to 32C. FIG. 32A is a front view, and FIG. 32B is a side view. A dimension S indicates a spacing in mm between adjacent electron beams in a triode section of the electron gun. Other dimensions in FIGS. 32A and 32B are as follows:

H (0.37–2.8)S

L (0.19–2.8)S (area A of pole piece)/(total area of cutout portions B)=1–90

D=(0.2–0.8)S

T=(0.25–0.8)S

L/D=0.23–13.7

H/D=0.47–13.7

FIG. 12A is a front view, seen from the phosphor screen side, illustrating a further example of a deflection defocusing correcting magnetic member used for the cathode ray tube of the present invention; FIG. 12B is a sectional view taken on line XIIB—XIIB of FIG. 12A; and FIG. 12C is a sectional view taken on line VIIC—XIIC of FIG. 12A. In FIG. 12A to 12C, parts corresponding to those in FIGS. 7A to 7C are indicated by the same characters as in FIGS. 7A to 7C.

A deflection defocusing correcting magnetic member 39 shown in this example is a modification of that shown in FIGS. 11A to 11C, is formed in a such a shape (circular shape in the figures) as to form a homogeneous magnetic field corresponding to the vertical deflection and to be shorter in axial length with an increasing distance from the tube axis.

By the use of the deflection defocusing correcting magnetic member 39, an electron beam is focused in both the vertical and vertical directions when deflected to the corners of the screen.

FIG. 13A is a front view, seen from the phosphor screen side, illustrating a further example of a deflection defocusing correcting magnetic member used for the cathode ray tube of the present invention; FIG. 13B is a sectional view taken on line XIIIB—XIIIB of FIG. 13A; and FIG. 13C is a sectional view taken on line VIIIC—XIIIC of FIG. 13A. In FIG. 13A to 13C, parts corresponding to those in FIGS. 7A to 7C are indicated by the same characters as in FIGS. 7A to 7C.

A deflection defocusing correcting magnetic member 39 in this example has three pairs of pole pieces 39R, 39G and 39B. Each pair have portions opposing each other in parallel (trapezoidal portions) for modifying the horizontal deflection magnetic field into the exaggerated barrel shape, and also provide inwardly extending portions above and below an electron beam in the direction perpendicular to the in-line direction for producing a homogeneous magnetic field thereby diverging the electron beam in the vertical direction.

With this configuration, the horizontal diameter of a beam spot of an electron beam deflected in the horizontal direction can be reduced.

FIG. 14A is a front view, seen from the phosphor screen side, illustrating a further example of a deflection defocusing correcting magnetic member used for the cathode ray tube of the present invention; FIG. 14B is a sectional view taken on line XIVB—XIVB of FIG. 14A; and FIG. 14C is a sectional view taken on line VIVC—XIVC of FIG. 14A. In FIG. 14A to 14C, parts corresponding to those in FIGS. 7A to 7C are indicated by the same characters as in FIGS. 7A to 7C.

A deflection defocusing correcting magnetic member 39 shown in this example is provided with side pieces 39R' and 39B' outside of the side pole pieces 39R and 39B, in addition to the configuration shown in FIGS. 11A to 11C, for suppressing an imbalance between beam spot shapes of side beams deflected leftward and rightward in the in-line direction, and also correcting coma by the deflection magnetic field.

FIG. 15A is a front view, seen from the phosphor screen side, illustrating a further example of a deflection defocusing correcting magnetic member used for the cathode ray tube of the present invention; FIG. 15B is a sectional view taken on line XVB—XVB of FIG. 15A; and FIG. 15C is a sectional view taken on line XVC—XVC of FIG. 15A. In FIG. 15A to 15C, parts corresponding to those in FIGS. 7A to 7C are indicated by the same characters as in FIGS. 7A to 7C.

A deflection defocusing correcting magnetic member 39 in this example is configured that, in addition to the configuration shown in FIGS. 14A to 14C, a spacing HI between upper and lower opposing portions of the inner pole piece of a pair of side pole pieces 39R or 39B is shorter than a spacing HO of the upper and lower opposing portions of the outer pole piece for further improving the effects provided by the configuration shown in FIGS. 14A to 14C.

FIG. 16A is a front view, seen from the phosphor screen side, illustrating a further example of the present invention in which a deflection defocusing correcting magnetic member is applied to a projection type cathode ray tube having a single electron gun; FIG. 16B is a sectional view taken on line XVIB—XVIB of FIG. 16A; and FIG. 16C is a sectional view taken on line XVIC—XVIC of FIG. 16C.

A deflection defocusing correcting magnetic member 390 shown in FIGS. 16A to 16C, having the same configuration as that of the magnetic member applied to the three-gun cathode ray tube shown in FIG. 7A to 7C, is applied to a single-gun cathode ray tube. The effects of the magnetic member 390 are he same as those of the magnetic member shown in FIGS. 7A o 7C.

Figure 33A:
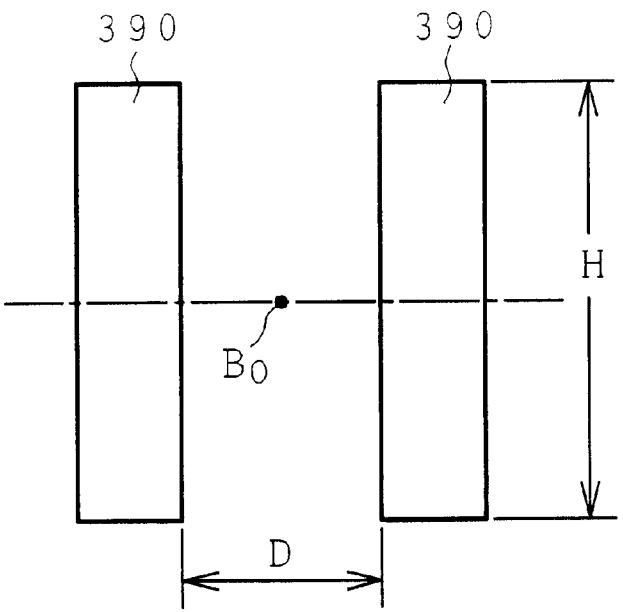
FIG. 33A is a further numerical example of the present invention.
Figure 33B:
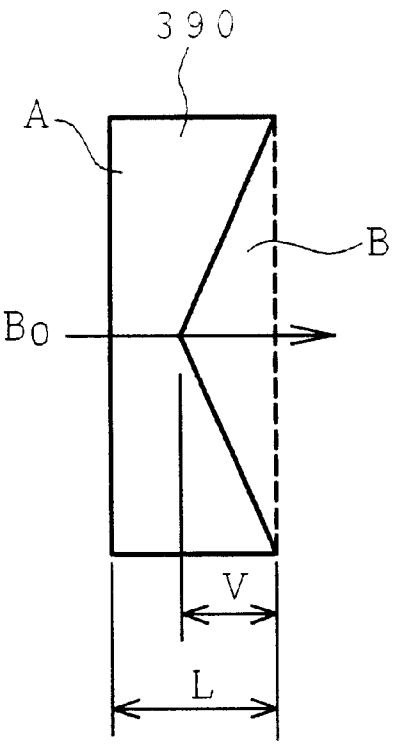
FIG. 33B is a side view thereof.

A concrete modification of the example shown in FIGS. 16A to 16C is shown in FIGS. 33A and 33B. FIG. 33A is a front view, and FIG. 33B is a side view.

L=(0.05–1.48)F

D=(0.25–1.1)F

H=(0.1–1.43)F

V=(0.05–1.48)F

L/D=0.07–4.0

H/D=0.13–4.0

(area A of a pole piece)/(area B of a cutout portion)=1–39

Here, character F indicates a diameter of an aperture of an anode electrode forming a main lens in the direction perpendicular to scanning lines.

FIG. 17A is a front view, seen from the phosphor screen side, illustrating a further example of the present invention in which a deflection defocusing correcting magnetic member is applied to a projection type cathode ray tube having a single electron gun; FIG. 17B is a sectional view taken on line XVIIB—XVIIB of FIG. 17A; and FIG. 17C is a sectional view taken on line XVIIC—XVIIC of FIG. 17C.

A deflection defocusing correcting magnetic member 390 shown in FIGS. 17A to 17C, having the same configuration as that of the magnetic member applied to the three-gun cathode ray tube shown in FIG. 11A to 11C, is applied to a single-gun cathode ray tube. The effects of the magnetic member 390 are the same as those of the magnetic member shown in FIGS. 11A to 11C.

FIG. 18A is a front view, seen from the phosphor screen side, illustrating a further example of the present invention in which a deflection defocusing correcting magnetic member is applied to a projection type cathode ray tube having a single electron gun; FIG. 18B is a sectional view taken on line XVIIIB—XVIIIB of FIG. 18A; and FIG. 18C is a sectional view taken on line XVIIIC—XVIIIC of FIG. 18C.

A deflection defocusing correcting magnetic member 390 shown in FIGS. 18A to 18C, having the same configuration as that of the magnetic member applied to the three-gun cathode ray tube shown in FIG. 13A to 13C, is applied to a single-gun cathode ray tube. The effects of the magnetic member 390 are the same as those of the magnetic member shown in FIGS. 13A to 13C.

As described above, according to the embodiments of the present invention, there can be provided a cathode ray tube enabling control of focusing of the electron beam on the phosphor screen in synchronism with beam deflection without applying a dynamic signal synchronized with deflection of an electron beam to an electrode of an electron gun and ensuring uniformity of display quality over the entire screen at a low cost. Actually, the above conditions are not uniquely determined because they are dependent on the structure of a cathode ray tube including the maximum deflection angle used, the structure of a deflection magnetic field generating portion, pole pieces for forming the above uniform magnetic field, the structure of the electron gun except for the portions for forming the uniform magnetic field, operating conditions of the cathode ray tube, application use of the cathode ray tube and the like.

In order to improve uniformity of resolution over the entire phosphor screen by establishing in the magnetic deflection field a magnetic field distribution having a region of a uniform magnetic field corresponding to a magnetic deflection field strength with an axial boundary of the region varying with a distance thereof from a tube axis, the magnetic field distribution must be such that an axial extent of the region having a uniform magnetic field traversed by the electron beam vary with the beam deflection amount.

Figure 19A:
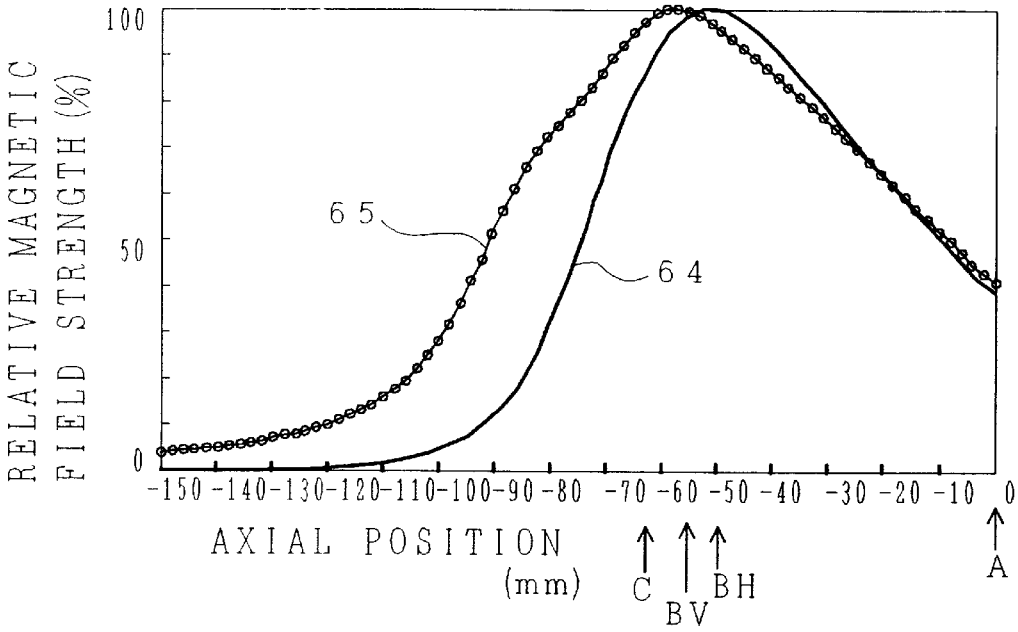
Figure 19B:
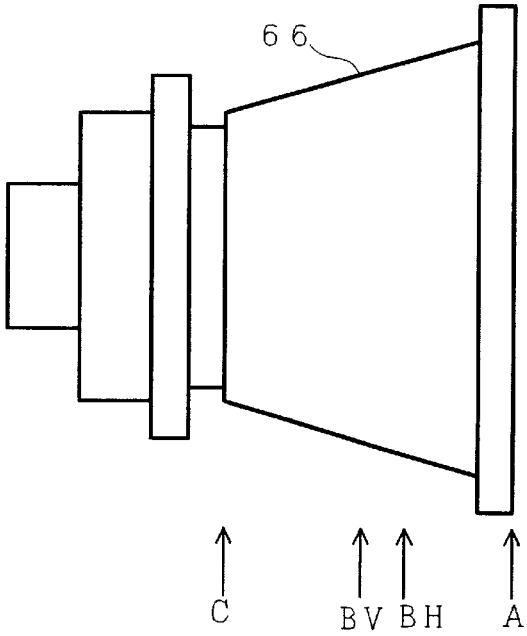

FIGS. 19A and 19B illustrate a deflection magnetic field distribution, wherein FIG. 19A is a diagram illustrating an example of a deflection magnetic field distribution on a tube axis of a cathode ray tube having a deflection angle of 100° or more, and FIG. 19B is a view illustrating a positional relationship between the deflection magnetic field distribution shown in FIG. 19A and a deflection magnetic field generating mechanism.

In FIGS. 19A to 19B, the right side with respect to the paper plane is the side near the phosphor screen, and the left side is the side remote from the phosphor screen.

In FIGS. 19A and 19B, character A indicates a reference point for measurement of a magnetic field; BH is a point at which a magnetic flux density distribution 64 of the magnetic field for deflecting the electron beam in the direction of scanning lines has the maximum value; BV is a point at which a magnetic flux density distribution 65 of the magnetic field for deflecting the electron beam in the direction perpendicular to the scanning line has the maximum value; and C is an end remote from the phosphor screen of a cathode ray tube, of a magnetic material forming a core of the coil for generating the deflection magnetic field.

In the case where end portions of the magnetic pieces on the phosphor screen side have indentations in an axial direction of the cathode ray tube, the longest portion is taken as the above distance.

Figure 20A:
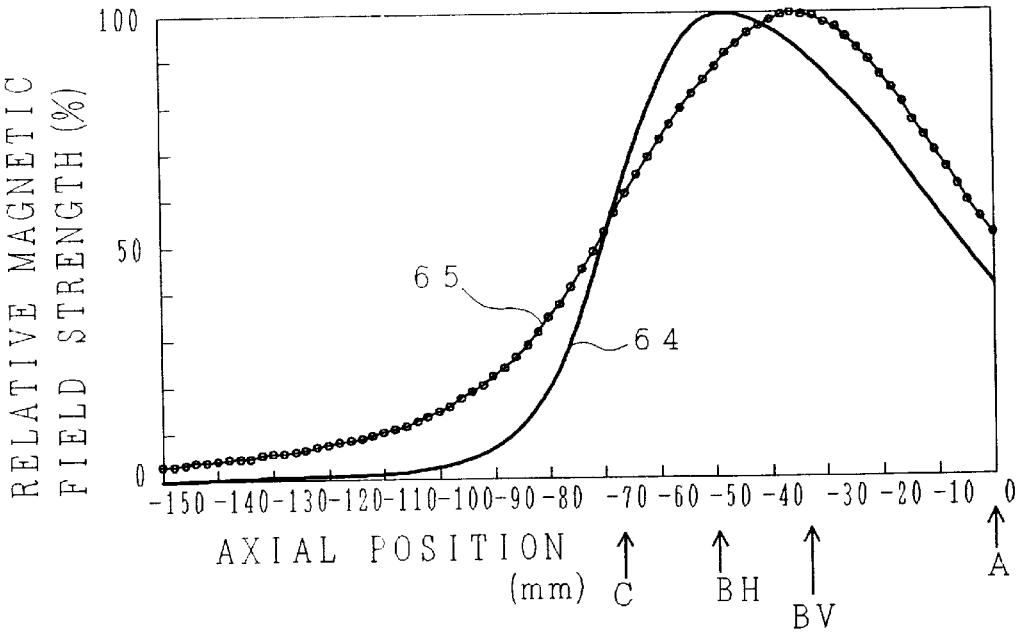
Figure 20B:
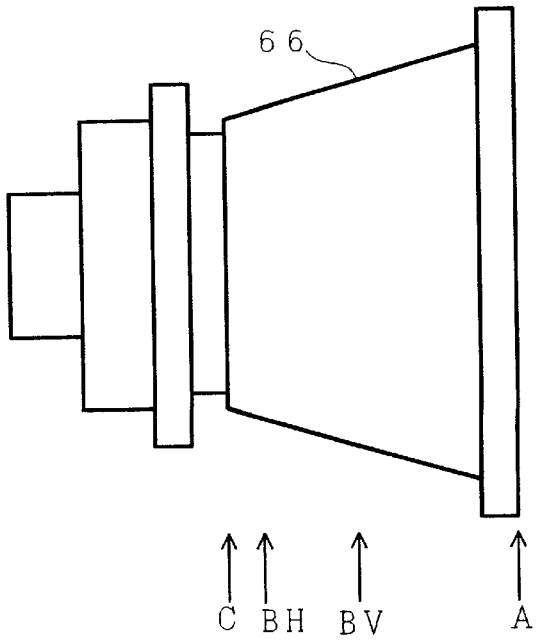

FIGS. 20A and 20B illustrate a deflection magnetic field distribution, wherein FIG. 20A is a diagram illustrating an example of a deflection magnetic field distribution on a tube axis of a cathode ray tube having a deflection angle of 100° or less, and FIG. 20B is a view illustrating a positional relationship between the deflection magnetic field distribution shown in FIG. 20A and a deflection magnetic field generating mechanism.

In FIGS. 20A to 20B, the right side with respect to the paper plane is near the phosphor screen, and the left side is remote from the phosphor screen. Character A indicates a reference point for measurement of a magnetic field; BH is a point at which a magnetic flux density distribution 64 of the magnetic field for deflecting the electron beam in the direction of scanning lines has the maximum value; BV is a point at which a magnetic flux density distribution 65 of the magnetic field for deflecting the electron beam in the direction perpendicular to the scanning line has the maximum value; and C is an end remote from the phosphor screen of a cathode ray tube, of a magnetic material forming a core of the coil for generating the deflection magnetic field.

The deflection defocusing correcting magnetic member 39 is actually sealed into a color cathode ray tube in which the outside diameter of a neck portion is 29 mm, the maximum deflection angle is 112°, and the phosphor screen size is 68 cm.

The above cathode ray tube, combined with the deflection magnetic field shown in FIG. 19A and provided with the deflection defocusing correcting magnetic member disposed at a position of 96 mm along the tube axis, was tested with the anode voltage of 30 kV, and exhibited good results.

The position of the deflection defocusing correcting magnetic member in a deflection magnetic field is not uniquely determined because it is dependent on the structure of a cathode ray tube including the maximum deflection angle used, the structure of a deflection magnetic field generating portion, pole pieces for forming the above uniform magnetic field, the structure of the electron gun except for the portions for forming the uniform magnetic field, operating conditions of the cathode ray tube, application use of the cathode ray tube and the like.

The deflection defocusing correcting magnetic member for establishing in the magnetic deflection field a magnetic field distribution having a region of a uniform magnetic field corresponding to a magnetic deflection field strength with an axial boundary of the region varying with a distance thereof from a tube axis, is actually sealed into a color cathode ray tube in which the outside diameter of a neck portion is 29 mm, the maximum deflection angle is 90°, and the phosphor screen size is 48 cm.

The above cathode ray tube, combined with the deflection magnetic field shown in FIG. 20A and provided with the deflection defocusing correcting magnetic member disposed at a position of 58 mm along the tube axis, was tested with the anode voltage of 30 kV, and exhibited good results.

The position of the deflection defocusing correcting magnetic member in a deflection magnetic field is not uniquely determined because it is dependent on the structure of a cathode ray tube including the maximum deflection angle used, the structure of a deflection magnetic field generating portion, pole pieces for forming the above uniform magnetic field, the structure of the electron gun except for the portions for forming the uniform magnetic field, operating conditions of the cathode ray tube, application use of the cathode ray tube and the like.

Figure 29:
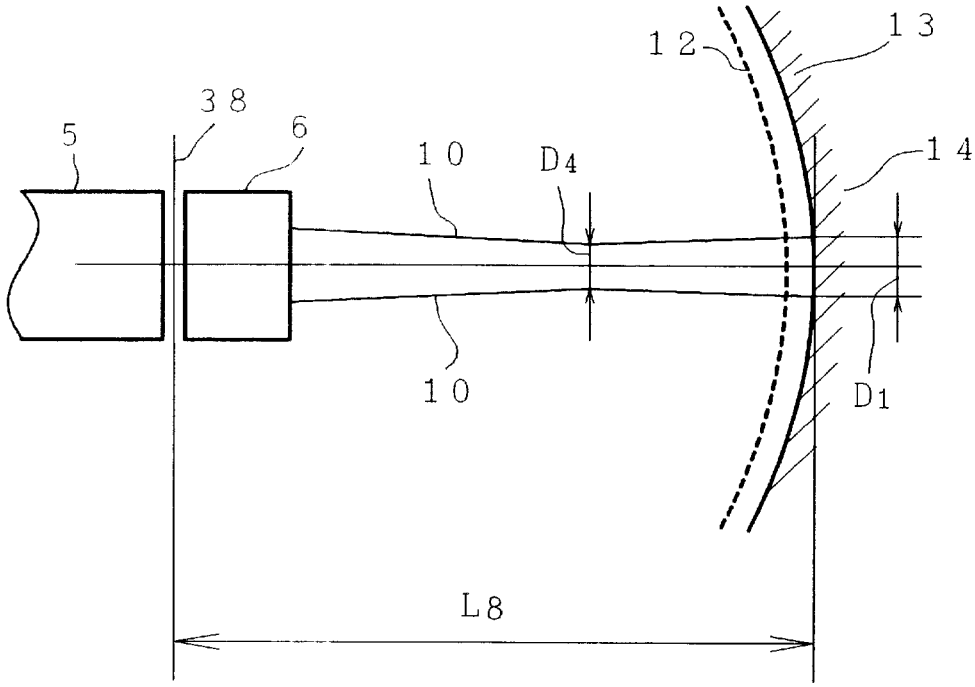
FIG. 29 is a view illustrating an effect of a space-charge repulsion on electron beams between a main lens and a phosphor screen.
Figure 30:
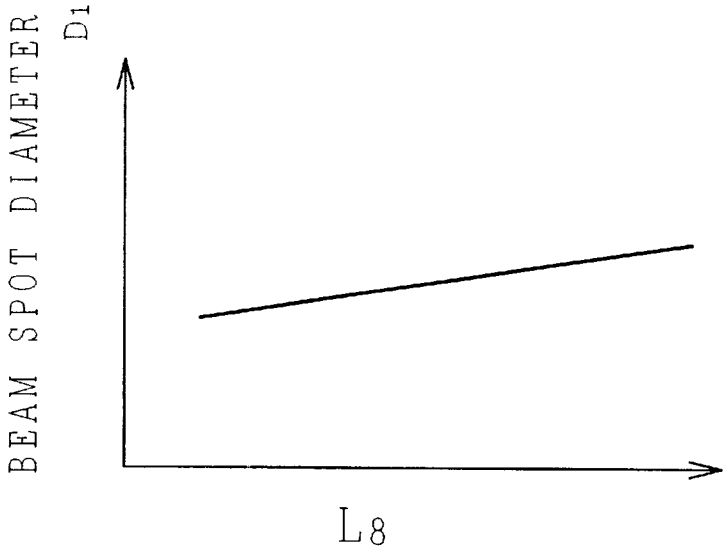
FIG. 30 is a diagram illustrating a relationship between a distance from a main lens to a phosphor screen and a diameter of an electron beam spot on the phosphor screen.

FIGS. 29 and 30 show a relationship between a distance from a main lens to a phosphor screen and the diameter of an electron beam spot formed on the phosphor screen. For a cathode ray tube driven in the same condition, the above function is dependent on the distance from the main lens to the phosphor screen, and the beam spot diameter increases with increasing distance.

FIG. 29 is a view illustrating an effect of space-charge repulsion on an electron beam between the main lens and the phosphor screen. In FIG. 29, reference numeral L8 indicates a distance between a main lens 38 and a phosphor screen 13.

Referring to FIG. 29, as an electron beam 10 is sufficiently away from an anode electrode 6, the space around of the electron beam 10 becomes at an anode potential, and substantially free from an electric field. In such a state, the electron beam 10 traveling under a focusing action by the main lens 38 begins to experience an increasing action by space-charge repulsion forcing the electron beam to change its trajectory, is focused to a the minimum diameter $D_4$ before reaching the phosphor screen 13, increases its diameter as it approaches the phosphor screen 13 and forms a spot of a diameter $D_1$ on the phosphor screen 13.

FIG. 30 is a graph showing a relationship between the distance from the main lens to the phosphor screen and the diameter of an electron beam spot. For the cathode ray tube driven in the same condition, the above action is dependent on a distance L8 between the main lens 38 and the phosphor screen 13, and the beam spot diameter D1 increases with increasing distance L8.

According to the configuration of the present invention, there can be obtained the following functions and effects:

(1) In a cathode ray tube, generally, the amount of deflection defocusing rapidly increases with an increasing amount of beam deflection. The present invention corrects deflection defocusing as the electron beam is deflected and changes its trajectory in a magnetic deflection field, by incorporation of such magnetic pole pieces into a cathode ray tube as to establish a magnetic field distribution for exerting a focusing or diverging force on an electron beam and having a region of a uniform magnetic field with an axial boundary thereof varying with a distance thereof from a tube axis (hereinafter referred to as "an axial-boundary-varying uniform magnetic field region").

(2) In a cathode ray tube, the amount of deflection defocusing of an electron beam increases with increasing deflection angle. According to the present invention, there is established an axial-boundary-varying uniform magnetic field region capable of increasing the amount of deflection defocusing correction correspondingly to the amount of beam deflection when an electron beam is deflected and changes its trajectory in a deflection magnetic field, and hence capable of correcting deflection defocusing increasing rapidly with the amount of deflection.

(3) An example of the axial-boundary-varying uniform magnetic field region capable of increasing a focusing or diverging action exerted on an electron beam properly correspondingly to the amount of deflection when the electron beam is deflected and changes its trajectory in a deflection magnetic field is effectively obtained by establishing a pair of magnetic field distributions having an axial-boundary-varying uniform magnetic field region, substantially symmetrically on opposite sides of the trajectory of the undeflected electron beam or asymmetrically with respect to the trajectory of the undeflected electron beam.

The amount of the focusing or diverging action to be exerted on an electron beam becomes larger as the electron beam moves away from the trajectory of the undeflected electron beam.

Compared with the undeflected electron beam, the electron beam deflected to traverse a pair of magnetic field disposed on opposite sides of the trajectory of the undeflected beam for providing a diverging action on the electron beam corresponding to a deflection magnetic field diverges as it travels through the magnetic field and the bundle of the deflected beams moves away from the trajectory of the undeflected beam.

The rate of change in trajectory of a deflected electron beam is larger on the side of the deflected electron beam remote from the trajectory of the undeflected electron beam than that on the other side of the deflected electron beam. This is because the amount of magnetic fluxes linked with by the electron beam increases with the travel of the deflected electron beam along the tube axis as the deflected electron beam moves away from the trajectory of the undeflected electron beam. The reason why the amount of the magnetic fluxes linked with by the electron beam increases is that a spacing between lines of magnetic force becomes narrow (the magnetic flux density increases) and/or an area having a magnetic field becomes wide.

In a cathode ray tube, generally, a distance between a main lens of an electron gun and the center of a phosphor screen is longer than a distance between the main lens and the periphery of the phosphor screen. As a result, in the case there a deflection magnetic field has no focusing or diverging action, adjustment for optimum focus of an electron beam at the center of the phosphor screen overfocuses the other electron beam at the periphery of the phosphor screen.

According to the present invention, by establishing an axial-boundary-varying uniform magnetic field region in the above deflection magnetic field, a diverging action exerted on an electron beam increases depending upon the axial extent of the uniform magnetic field region with an increasing amount of deflection of the electron beam, reduces overfocusing of the electron beam at the periphery of the phosphor screen, and hence corrects deflection defocusing correspondingly to the amount of deflection.

According to the present invention, in the case where a deflection magnetic field has a focusing action exerted on an electron beam, by establishing an axial-boundary-varying uniform magnetic field region higher in strength in the deflection magnetic field, the increase in the focusing action depending upon the axial extent of the uniform magnetic field region corresponding to an increasing amount of deflection of the electron beam can exceed the increase in the focusing action caused by the deflection magnetic field, to thereby correct deflection defocusing including overfocusing of the electron beam at the periphery of the phosphor screen caused by the geometry of the cathode ray tube.

(4) FIG. 27 is a view illustrating a focusing condition of an electron beam on a phosphor screen. In FIG. 27, reference numeral 5 indicates a fifth grid electrode; 6 is a sixth grid electrode; 13 is a phosphor screen; and 38 is a main lens.

FIG. 28 is a view illustrating scanning lines formed on a panel portion forming a phosphor screen of a cathode ray tube. In FIG. 28, reference numeral 14 indicates a panel portion, and 60 is a scanning locus.

In a cathode ray tube, deflection is generally performed by scanning electron beams linearly as shown in FIG. 28. The linear scanning locus 60 is called a scanning line.

A deflection magnetic field in the direction (X-X) of a scanning line is often different from that in the direction (Y-Y) perpendicular to the scanning line. Also, a focusing action exerted on an electron beam in the direction of the scanning direction is often made different from that in the direction perpendicular to the scanning line by actions of at least one of a plurality of electrodes of an electron gun before the electron beam experiences a substantial action of an axial-boundary-varying uniform magnetic field region established in the deflection magnetic field.

Further, importance is attached to correction of a deflection defocusing correction in the direction of a scanning line or in the direction perpendicular to the scanning line depending on the application of a cathode ray tube. The techniques and the necessary cost vary depending on the direction with respect to the beam scanning line of and the amount of a deflection defocusing to be corrected, and the present invention is applicable to the technique.

Accordingly, in many cases, respective suitable means corresponding to the above conditions are different from each other; however, according to the present invention, there is provided a suitable means corresponding to the above conditions.

(5) In the case where an axial-boundary-varying uniform magnetic field region having a focusing action corresponding to a deflection magnetic field substantially centered on the trajectory of the undeflected electron beam is established, the deflected electron beams traversing a region away from the trajectory of the undeflected electron beam is focused more strongly than the undeflected electron beam while traveling in the uniform magnetic field region, and at the same time a bundle of the deflected electron beams moves away from the trajectory of the undeflected electron beam.

In this case, the rate of change in trajectory of a deflected electron beam on the side of the electron beam remote from the trajectory of the undeflected electron beam is smaller than that on the other side. This is because the amount of magnetic fluxes linked with by the electron beam decreases as the deflected electron beam moves away from the trajectory of the undeflected electron beam. The reason why the amount of the magnetic fluxes linked with by the electron beam decreases is that a spacing between lines of magnetic force becomes wide (the magnetic flux density decreases) and/or an area having a magnetic field becomes narrow.

Figure 26A:
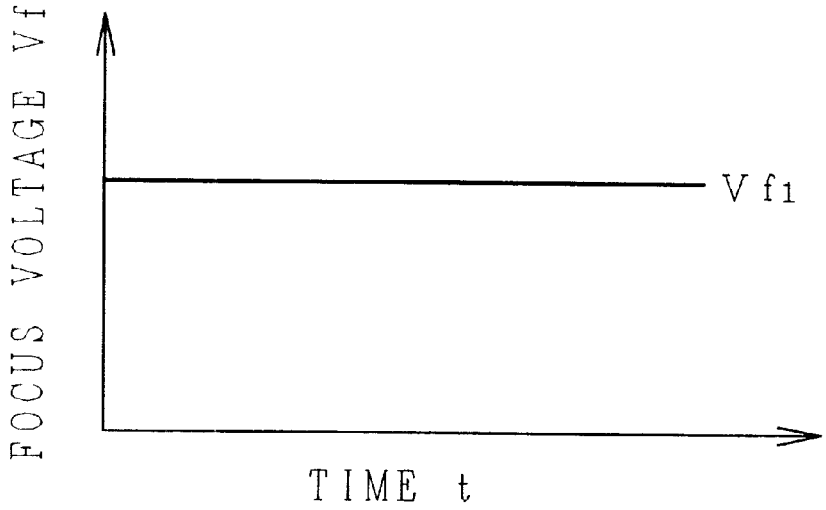
FIGS. 26A and 26B are diagrams illustrating focus voltages supplied to the electron guns shown in FIGS. 25A and 25B, respectively.
Figure 26B:
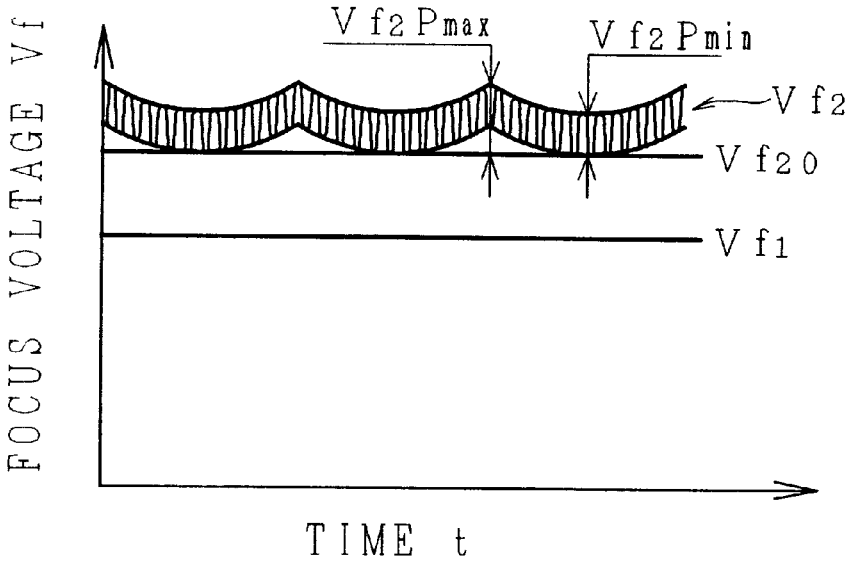

In the case where a deflection magnetic field has a diverging action exerted on an electron beam, by establishing such an axial-boundary-varying uniform magnetic field region in the deflection magnetic field as to increase a focusing action exerted on an electron beam with an increasing amount of deflection of the electron beam and to reduce overfocusing of the electron beam at the periphery of the phosphor screen, it is possible to correct deflection defocusing correspondingly to the amount of deflection as described with reference to FIG. 26.

The techniques and the necessary cost vary depending on the direction with respect to the beam scanning line of and the amount of a deflection defocusing to be corrected, and the present invention is applicable to the technique.

(6) In a color cathode ray tube generating three in-line electron beams in a horizontal line, a barrel-shaped distribution of lines of magnetic force is used for a vertical deflection magnetic field and a pincushion-shaped distribution of lines of magnetic force is used for a horizontal deflection magnetic field as shown in FIG. 23, in order to simplify a circuit for controlling convergence of three electron beams on the phosphor screen.

The amount of deflection defocusing of side electron beams of three in-line electron beams caused by a vertical deflection magnetic field depends on both the strength of a vertical deflection magnetic field and the direction of horizontal deflection. For example, the amount of deflection focusing of an electron beam emitted from an electron gun on the right hand side in the in-line direction and deflected to the right side of the phosphor screen viewed from the phosphor screen side is different from that of the electron beam to the left side of the phosphor screen because a magnetic flux distribution of the deflection magnetic field traversed by the electron beam differs with directions of the beam deflection. As a result, the quality of an image created by the same electron gun differs with the sides of the phosphor screen.

To suppress the above difference in deflection defocusing between the electron beams deflected to the right and left sides, the amount of a focusing or diverging correcting action to be exerted on a side electron beam emitted from a side electron gun and traversing a region on the right hand side of the center axis of the side electron gun needs to be different from that to be exerted on a side electron beam emitted from the same side electron gun and traversing another region on the left hand side of the center axis.

For side electron beams of three electron beams arranged in a line, it is effective to establish, in a deflection magnetic field, an axial-boundary-varying uniform magnetic field region having different magnetic field distributions on the right and left sides with respect to the center axis of an electron gun.

In the case where an axial-boundary-varying uniform magnetic field region having different diverging forces exerted on an electron beam correspondingly to a deflection magnetic field asymmetrically on opposite sides of the trajectory of the undeflected electron beam is established, the deflected electron beams traveling in the magnetic distribution diverge more than the undeflected electron beam, and at the same time a bundle of the deflected electron beams moves away from the trajectory of the undeflected electron beam.

Also, the rate of change in trajectory of a deflected electron beam is larger on the side of the deflected electron beam remote from the trajectory of the undeflected electron beam than that on the other side of the deflected electron beam. This is because the amount of magnetic fluxes linked with by the electron beam increases as the deflected electron beam moves away from the trajectory of the undeflected electron beam. The reason why the amount of the magnetic fluxes linked with by the electron beam increases is that a spacing between lines of magnetic force becomes narrow and/or an area having a magnetic field becomes wide. The rate of the increase in the amount of the magnetic fluxes becomes large as the space between lines of magnetic force becomes rapidly narrow and/or the area having a magnetic field becomes rapidly wide.

Besides, on the other side of the magnetic distribution of the uniform magnetic field region, in which the rate of decrease in the spacing between lines of magnetic force is small and/or the rate of increase in the area having a magnetic field is small, the deflected electron beams traveling the magnetic distribution diverge more than the undeflected electron beam, and at the same time a bundle of the deflected electron beams moves away from the trajectory of the undeflected electron beam.

Also, the rate of change in trajectory of a deflected electron beam is larger on the side of the deflected electron bean remote from the trajectory of the undeflected electron beam than that of the deflected electron beam on the other side. However, the rate of change in trajectory is smaller than that of the above case in which the rate of decrease in the spacing between lines of magnetic force is large and/or the rate of increase in the area having a magnetic field is large. This is because the rate of the amount of increase in magnetic flux linkage is small when the electron beam moves away from the trajectory of the undeflected electron beam. The reason why the rate of increase in the amount of the magnetic flux linkage is small is that the rate of reduction in the spacing between lines of magnetic force is small and/or the rate of increase in the area having a magnetic field is small.

Thus, by establishing, in a deflection magnetic field, a magnetic field region for generating a diverging action increasing with an increasing amount of deflection depending on the direction of deflection, it is possible to correct deflection defocusing of the electron beam.

Figure 4B:
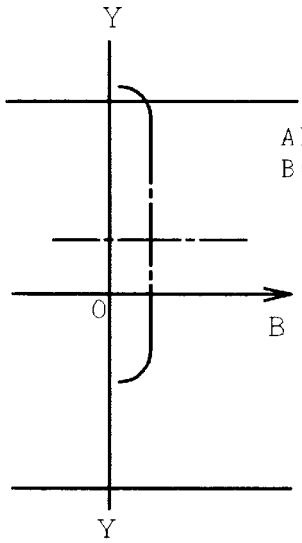
FIGS. 4B and 4D are magnetic flux density distribution diagrams thereof.
Figure 4A:
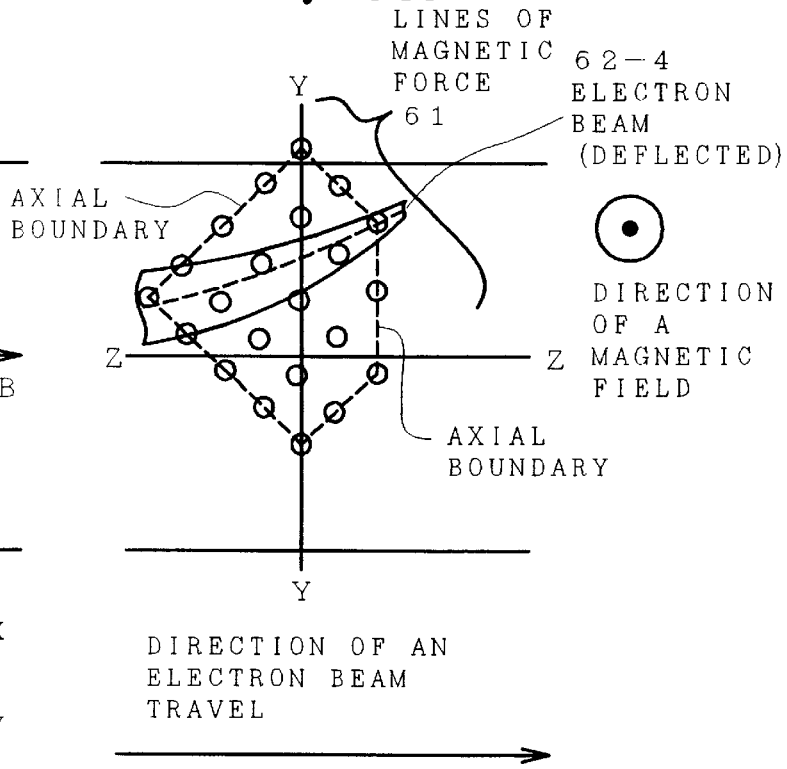
FIGS. 4A and 4C are schematic sectional views illustrating a fifth embodiment of the present invention.
Figure 4D:
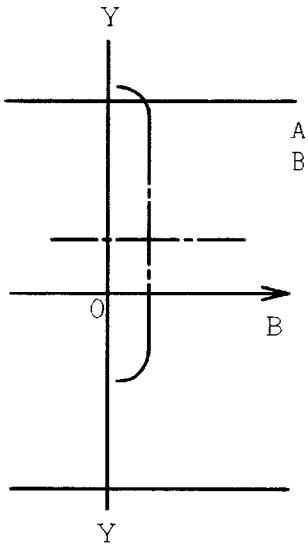
Figure 4C:
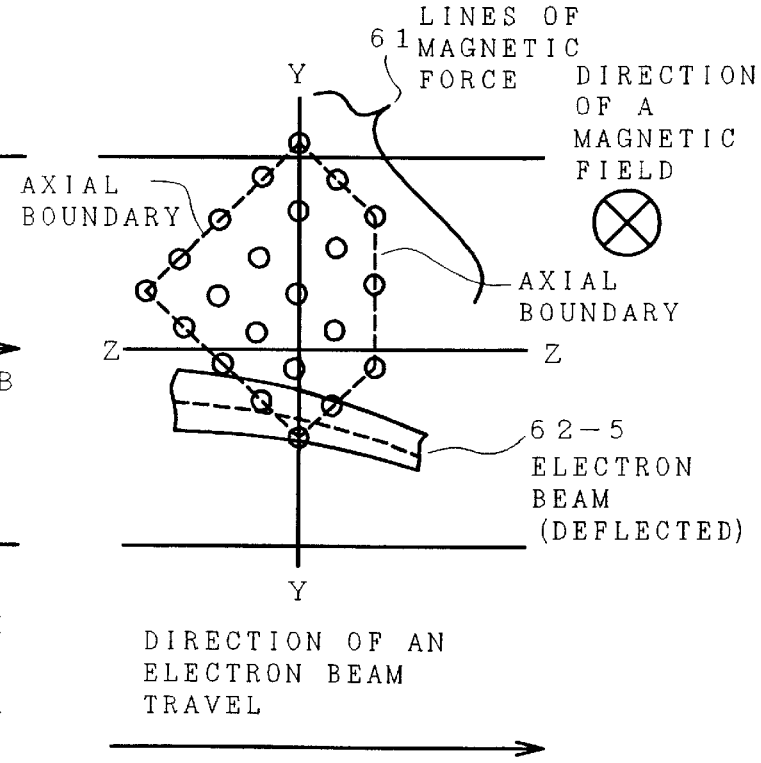

In the case where a deflection magnetic field has a diverging action exerted on an electron beam and causes deflection defocusing different depending on the direction of deflection, by establishing a uniform magnetic field region as shown in FIGS. 4A to 4C in the deflection magnetic field, it is possible to increase a focusing action generated by the magnetic field region with an increasing amount of deflection depending on the direction of deflection, and hence to correct deflection defocusing of the electron beam.

(7) In order to improve uniformity of resolution over the entire phosphor screen by establishing an axial-boundary-varying uniform magnetic field region in a deflection magnetic field, an electron beam needs to be deflected in the above uniform magnetic field region so as to traverse a magnetic field region having a necessary amount of distribution. Accordingly, the above uniform magnetic field region is limited by a positional relationship with the deflection magnetic field.

At the same time, the effect of correcting deflection defocusing is dependent on the amount of magnetic fluxes of the above uniform magnetic field region formed in the deflection magnetic field. The amount of magnetic fluxes is dependent on both the magnetic flux density and an area having a magnetic field. The above uniform magnetic field region is produced between at least two pole pieces formed of magnetic pieces. The magnetic flux density and the area having the magnetic field, which are not uniquely determined because they are dependent on the structures and positions of the above at least two pole pieces and also on the combination of magnetic fluxes in the magnetic poles, must be determined considering the practical diameter of an electron beam traversing the above uniform magnetic field region, the practical magnetic flux density and the like.

While the above uniform magnetic field region is produced between at least two pole pieces formed of magnetic pieces as described, pole pieces for correcting deflection defocusing correspondingly to the amount of deflection, that is, for forming the above uniform magnetic field region are called a deflection defocusing correcting magnetic member. The number of pole pieces of the deflection defocusing correcting magnetic member is not limited. A plurality of the pole pieces may be disposed, or part of a separate electrode may serves as the pole piece.

As is well known, the amount of magnetic fluxes necessary for deflection is dependent on a phosphor potential, and it can be normalized by dividing it by the square root of the phosphor potential. The use of the normalized value of the amount of magnetic fluxes makes clear the trajectory of an electron beam in the above uniform magnetic field region, to improve the accuracy in setting the magnetic field, thereby realizing a suitable deflection defocusing correction.

The necessary amount of magnetic fluxes is dependent on the area having the magnetic field and the magnetic flux density. The wider the area having the magnetic field, the smaller the necessary magnetic flux density may be. The magnetic flux density of the axial-boundary-varying uniform magnetic field region is dependent on the positional relationship between a pair of adjacent pole pieces, the magnetic flux density in the pole pieces, and the structure of the deflection defocusing correcting magnetic member for forming the uniform magnetic field region. As the positions of the pair of the adjacent pole pieces are closer to each other, the strength of the magnetic field in the vicinity of an electron beam becomes larger. However, the distance therebetween cannot be set at zero.

The magnetic field can be strengthened by increasing the magnetic flux density between the adjacent pole pieces. However, the excessively increased magnetic field distorts the trajectory of an electron beam not deflected so much, that is, an electron beam impinging around the center of the phosphor screen of the cathode ray tube severely by the effect of the axial-boundary-varying uniform magnetic field region, to thereby degrade resolution in the vicinity of the center of the phosphor screen to an extent not to be neglected. As a result, the increase in the amount of the magnetic flux density between the adjacent pole pieces has a limitation.

It may be expected to produce a focusing or diverging action exerted on an electron beam correspondingly to a slight change in the trajectory of the electron beam, by narrowing a spacing between a pair of pole pieces of the deflection defocusing correcting magnetic member forming the above uniform magnetic field region. However, in consideration of the diameter of an electron beam, the spacing between the pair of the pole pieces formed of magnetic pieces for forming the above uniform magnetic field region is practically limited to about 0.5 mm. In view of the foregoing, according to the present invention, for a cathode ray tube having the maximum deflection angle of 100° or more, it is effective to set the normalized magnetic flux density as below:

$$B\cdot(Eb)^{-1/2} \geqq 0.02\ \mathrm{mT}\cdot(\mathrm{kV})^{-1/2}$$

where B is in mT and Eb is an anode voltage applied to an electrode nearest said phosphor screen of said plurality of electrodes in kilovolts.

In the case where the pole pieces on the phosphor screen side have indentations in the axial direction of the cathode ray tube, the longest portions are used for measurement of the above distance.

(8) A deflection magnetic field distribution of the cathode ray tube is determined by the structure of a deflection device. When the maximum deflection angle is chosen, the maximum magnetic flux density on the tube axis of the normalized magnetic flux density by the root of the phosphor potential is substantially determined. As one method of setting the position of the axial-boundary-varying uniform magnetic field region in a deflection magnetic field, the location of the uniform magnetic field region may be specified in terms of a location having a magnetic flux density higher than a certain fraction of the maximum flux density.

The above method is advantageous in that the magnetic flux density can be significantly simply measured as compared with the method of setting the position of the uniform magnetic field region based on the absolute value of the magnetic flux density. In other words, this method allows measurement of the magnetic flux density to be sufficiently relatively performed by comparison with the maximum magnetic flux density, and thereby it is very effective in terms of practical use. Although the maximum magnetic flux density vary with the shape of the magnetic pieces and has an error depending thereon, such an error of the maximum flux density is acceptable for practical use.

According to the present invention, for the cathode ray tube having the maximum deflection angle of 100° or more, in consideration of the limitations described in the paragraph (7) relating to the structures of the pole pieces formed of the magnetic pieces and the positional relationship between the pair of the pole pieces, it is practically effective to set the level of the magnetic flux density at 5% or more of the maximum magnetic flux density on the tube axis measured at an end on the phosphor screen side of the pole pieces for forming the above uniform magnetic field region.

(9) The magnetic flux density, which is dependent on a permeability of a magnetic path, is closely related to a position from a magnetic material forming a core of a coil for generating a deflection magnetic field. One method of determining a region of a necessary magnetic flux density is to specify a distance between the pole pieces formed of the magnetic pieces for forming the uniform magnetic field region and the magnetic core material. In this method, if the position of the core of the coil for generating the deflection magnetic field is determined, the measurement of the magnetic flux density can be omitted. Accordingly this method is very effective in terms of practical use.

Although the distribution of the magnetic flux density vary with the shape of the magnetic core material and has an error depending thereon, such an error of the distribution of the magnetic flux density is acceptable for practical use.

According to the present invention, for the cathode ray tube having the maximum deflection angle of 100° or more, in consideration of the limitations described in the paragraph (7) relating to the structures of the pole pieces formed of the magnetic pieces and the positional relationship between the pair of the pole pieces, it is practically effective to set, at 50 mm or less, a distance between an end of the magnetic core material on the side thereof remote from the phosphor screen and an end on the phosphor screen side of the pole pieces for forming the above uniform magnetic field region.

In a case where the end of the pole pieces on the phosphor screen side have indentations in the axial direction of the cathode ray tube, the longest portions are used for measurement of the above distance.

(10) Similarly, according to the present invention, for a cathode ray tube having the maximum deflection angle of less than 100°, it is effective to set the normalized magnetic flux density equivalent to that described in the paragraph (7) as below:

$$B\cdot(Eb)^{-1/2} \geqq 0.004\ \mathrm{mT}\cdot(\mathrm{kV})^{-1/2}$$

where B is in mT and Eb is an anode voltage applied to an electrode nearest said phosphor screen of said plurality of electrodes in kilovolts.

It is practically effective to set the magnetic flux density equivalent to that described in the paragraph (8) at 10% or more; and it is practically effective to set the distance equivalent to that described in the paragraph (9) at 35 mm or less.

(11) The strength of the above uniform magnetic field region in a cathode ray tube cannot be unlimitedly increased from the practical viewpoints such as structures, ease of production, and ease of use, of a completed cathode ray tube and an electron gun used therefor.

According to the present invention, to achieve the effect in a magnetic field having a relatively low strength, an electron beam needs to have an appropriate diameter in the magnetic field region. In a cathode ray tube, generally, the diameter of an electron beam becomes large in the vicinity of a main lens. Accordingly, the position of the deflection defocusing correcting magnetic member for forming the uniform magnetic field region must be determined in consideration of its distance from the main lens.

If the above uniform magnetic field region is shifted extremely toward the cathode from the main lens portion, the astigmatism is canceled by the focusing action of the main lens, and also there easily occurs a problem in that some electron beams impinge upon some of electrodes of the electron gun.

According to the present invention, in consideration of variations including the maximum deflection angle of the cathode ray tube less than 85°, a single-beam electron beam and magnetic focusing of an electron beam, an end on the phosphor screen side of the pole pieces for forming the above uniform magnetic field region may be effectively set in a region ranging from 5 times or less the diameter of an aperture in the end face of the anode forming a main lens and facing a focusing electrode measured in the direction perpendicular to the scanning lines or not more than 180 mm, measured from the end face of the anode toward the phosphor screen, to 3 times or less the diameter of the aperture or not more than 108 mm measured from the end face of the anode toward the cathode.

(12) According to the present invention, a necessary amount of a magnetic flux density of a deflection magnetic field is required to achieve the effect in the above uniform magnetic field region. The pole pieces of the deflection defocusing correcting magnetic member may be made of a soft magnetic material. Further, part of the pole pieces may be made of a magnetic material having a high permeability, which function to further enhance the magnetic flux density of the magnetic field region and hence to further improve the deflection defocusing correction.

(13) According to the present invention, the pole pieces of the deflection defocusing correcting magnetic member need to be disposed in proximity to a trajectory of an electron beam. For example, the magnetic poles may be disposed on opposite sides of part of a trajectory of an electron beam. As described in the paragraph (3), the uniform magnetic field region corresponding to a deflection magnetic field is disposed symmetrically on opposite sides of the trajectory of the undeflected electron beam or disposed asymmetrically in the direction of deflection with respect to the tube axis.

The above two kinds of the uniform magnetic field regions can be established by provision of the pole pieces having appropriate structures. In general, electrode parts of an electron gun of a cathode ray tube are produced by pressing metal plates.

In recent years, focus characteristics of a cathode ray tube have been remarkably improved, and high accuracy is required for the electrode parts and also for the pole pieces of the deflection defocusing correcting magnetic member. In mass production, the pole pieces produced by pressing can be increased in accuracy and reduced in cost.

In many cases, deflection in a cathode ray tube is performed to form scanning lines as described above. In the cathode ray tube of the scanning line type, a phosphor screen is often formed in an approximately rectangular shape, and the scanning is generally performed substantially in parallel to the rectangular sides of the phosphor screen. In the cathode ray tube, the outer shape of an evacuated envelope containing the phosphor screen is also formed in an approximately rectangular shape matched with the shape of the phosphor screen in consideration of ease of assembly into an image display unit.

Accordingly, the above two kinds of uniform magnetic field regions of the present invention may be configured to be matched with the scanning lines and the shape of the phosphor screen for image formation. The uniform magnetic field may be directed in the direction of the scanning lines or the direction perpendicular to the scanning lines; however, the direction of the uniform magnetic field is dependent on the use of the cathode ray tube and thereby it cannot be uniquely determined.

(14) In the present invention, a spacing between the above pole pieces is closely related to the strength of a magnetic field formed by the pole pieces and to the trajectory of an electron beam traversing the spacing. The extremely large spacing reduces the effect of the magnetic pole pieces.

The depth of an image display unit using a cathode ray tube is limited by the axial length of the cathode ray tube and thereby it cannot be freely shortened.

One means for coping with such an inconvenience is to increase the maximum deflection angle of the cathode ray tube. The practical maximum deflection angle at present is 114° for a single-beam cathode ray tube, and is about 114° for a three in-line beam cathode ray tube.

The maximum deflection angle tends to be further increased in the future; however, the increased maximum deflection angle rapidly increases the maximum magnetic flux density of a deflection magnetic field. The maximum deflection angle is practically limited by a diameter of a neck portion of the cathode ray tube.

The outside diameter of the neck portion may be set at about 40 mm at maximum in terms of saving the power generating the deflection magnetic field and also saving materials of a mechanism portion for generating the deflection magnetic field.

In general, the maximum diameter of electrodes of an electron gun is smaller than the inside diameter of the neck portion of the cathode ray tube, and the neck portion requires a wall thickness of several mm for ensuring the mechanical strength and insulation, and preventing leakage of X-rays.

According to the present invention, in consideration of the limitations described in the paragraph (7) relating to the electrodes and the electric field, with respect to the pole pieces for establishing in a deflection magnetic field the axial-boundary-varying uniform magnetic field region for correcting deflection defocusing correspondingly to the deflection magnetic field, the optimum distance of the narrowest portion of the spacing between the pole pieces in the direction of the scanning lines or in the direction perpendicular to the scanning lines may be set to be 1.5 times or less the diameter of an aperture in the end face of the anode facing a focus electrode of the electron gun measured in the direction perpendicular to the scanning lines or to be in a range of 0.5 mm to 30 mm for saving cost and achieving the desired characteristics.

(15) According to the present invention, the above uniform magnetic field region can be established by providing a structure in which the pole pieces are disposed on opposite sides of the trajectory of an electron beam.

In the case where various kinds of cathode ray tubes are produced on a small scale, preparation of an expensive press die for each specification leads to the increased production cost. The pole pieces can be easily produced by cutting or etching a thin plate-like material, although the pole pieces produced by such methods are slightly inferior in accuracy to those produced by pressing. This eliminates the necessity of the expensive press die, and allows various kinds of the pole pieces to be produced on a small scale at a low cost.

According to the present invention, the optimum dimensional range of opposing portions of the magnetic poles are substantially the same as that of the spacing between the pole pieces described in the paragraph (14); however, the distance between two opposing portions of the magnetic poles is not set at zero. For a cathode ray tube of the scanning line type deflection, the opposing direction of the opposing portions may be that of the scanning lines or the direction perpendicular to the scanning lines.

(16) In the case where the deflection defocusing correcting magnetic member for establishing the axial-boundary-varying uniform magnetic field region corresponding to a change in the deflection magnetic field corrects deflection defocusing by increasing a diverging action on the electron beam correspondingly to the increase in the deflection amount, the magnetic field between the opposing portions of the pole pieces of the magnetic member needs to be higher in magnetic flux density than the deflection magnetic field having a focusing action on the electron beam in the vicinity thereof.

According to the present invention, the magnetic field between the opposing portions of the pole pieces is made higher than the deflection magnetic field in the vicinity thereof by providing suitable shapes of the pole pieces. In this case, any electrodes made of a conductive material may be not provided between the opposing portions of the pole pieces.

A magnetic path is formed by providing the above pole pieces in a deflection magnetic field having a sufficient magnetic flux density and choosing the structure of the pole pieces and the distance between the opposing portions of the pole pieces, to thereby establish, between the opposing portions of the pole pieces, a strong axial-boundary-varying uniform magnetic field region corresponding to a change in the deflection magnetic field.

As one means for establishing the above uniform magnetic field region corresponding to the deflection magnetic field, according to the present invention, a magnetic path composed of a ferromagnetic body having a soft magnetization characteristic is formed inside or/and outside the cathode ray tube.

The above uniform magnetic field region corresponding to the deflection magnetic field may be adjusted outside the cathode ray tube to further improve the accuracy of deflection defocusing correction.

(17) As described in the paragraph (11), in the case where deflection defocusing is corrected by establishing, in a deflection magnetic field, the axial-boundary-varying uniform magnetic field region corresponding to the deflection magnetic field, the uniform magnetic field region is expected to achieve the desired effects even in the magnetic field having a relatively low magnetic field, and for this purpose, the electron beam needs to have an appropriate diameter in the region.

In a cathode ray tube, generally, the diameter of an electron beam becomes large in the vicinity of a main lens. Although the position of the deflection defocusing correcting magnetic member is limited by a distance from the main lens, the distance from the main lens is not uniquely determined because the pole piece structure differs depending on a deflection magnetic field used, a structure of the electron gun, and an electron beam current condition, for example, a wide electron beam current range or a specific electron beam current range.

In a cathode ray tube, particularly, in an in-line type color picture tube or color display tube, a deflection magnetic field for deflecting electron beams is generally inhomogeneous for simplifying convergence adjustment. In such a case, a main lens of an electron gun may be separated from a deflection magnetic field generating portion as much as possible for avoiding distortions of an electron beam due to the deflection magnetic field, and accordingly, the deflection magnetic field generating portion is generally disposed at a position nearer a phosphor screen than the main lens.

(18) According to the present invention, in the case where deflection defocusing is corrected by establishing the axial-boundary-varying uniform magnetic field region in a deflection magnetic field, the deflection magnetic field generating portion can be disposed nearer the main lens by establishing the uniform magnetic field region allowing for distortions of an electron beam due to the inhomogeneous deflection magnetic field.

According to the present invention, for a cathode ray tube having a maximum deflection angle of 100° or more, the optimum distance between an end remote from a phosphor screen of a magnetic material forming a core of a coil for generating the deflection magnetic field and an end face facing a focus electrode of an anode electrode of the electron gun is set at 60 mm or less.

(19) Besides, the length from the cathode electrode to a main lens in an electron gun may be set longer for reducing an image magnification of the electron gun and making small a beam spot diameter on a phosphor screen.

Accordingly, the axial length of a cathode ray tube having good resolution in accordance with these two principles is made inevitably longer.

According to the present invention, however, by making the position of a main focusing lens near the phosphor screen without changing the length between the cathode electrode and the main lens in the electron gun, it becomes possible to further reduce the image magnification of the electron gun, to make smaller the electron beam spot diameter on the phosphor screen, and to shorten the axial length.

(20) Since a length of time the space-charge repulsion occurs in an electron beam is shortened by making the position of the main lens near the phosphor screen, the beam spot diameter on the phosphor screen can be further reduced.

(21) According to the present invention, to execute contents similar to those described in the paragraphs (18) to (20) with higher accuracy, the optimum distance between the deflection magnetic field and the main lens for the cathode ray tube having the maximum deflection angle of 100° or more is determined such that the opposing end faces of the electrodes for forming the main lens of the electron gun is disposed in a magnetic field area having 10% or more of the maximum magnetic flux density on the tube axis in the deflection magnetic field for deflection in the direction of the scanning lines or in the direction perpendicular to the scanning lines.

(22) According to the present invention, to execute contents similar to those described in the paragraphs (18) to (21) with a higher accuracy, the optimum distance between the deflection magnetic field and the main lens for the cathode ray tube having the maximum deflection angle of 100° or more is determined such that a region having the value of $B \cdot E^{-1/2}$ in a range of 0.004(millitesla·(kV)$^{-1/2}$) or more is included in the distance, where E (kV) is the phosphor potential and B (millitesla) is a magnetic flux density of a magnetic field for beam deflection in the direction of the scanning lines or in the direction perpendicular to the scanning lines at the opposing end faces of the electrodes forming the main lens of the electron gun.

(23) According to the present invention, to execute contents similar to those described in the paragraphs (18) to (22), the optimum distance between the deflection magnetic field and the main lens of the electron gun for the cathode ray tube having the maximum deflection angle θ in a range of $85° \leqq \theta < 100°$ is 40 mm or less in accordance with the contents equivalent to those described in the paragraphs (18) to (20), is specified in terms of 15% or more in accordance with the content equivalent to that described in the paragraph (21), and is specified in terms of 0.003 millitesla or more in accordance with the content equivalent to that described in the paragraph (22).

(24) According to the present invention, to execute contents similar to those described in the paragraphs (18) to (22), the optimum distance between the deflection magnetic field and the main lens of the electron gun for the cathode ray tube having the maximum deflection angle in a range of less than 85° is 170 mm or less in accordance with the contents equivalent to those described in the paragraphs (18) to (20), is specified in terms of 5% or more in accordance with the content equivalent to that described in the paragraph (21), and is specified in terms of 0.005 millitesla or more in accordance with the content equivalent to that described in the paragraph (22).

(25) As is apparent from the paragraphs (18) to (24), the optimum distance between the deflection magnetic field and the main lens of the electron gun can be shortened according to the present invention, unlike the prior art.

According to the present invention, the optimum positional relationship between the neck portion of the cathode ray tube and the main lens of the electron gun is such that the end face of the anode facing the main lens of the electron gun is positioned at a distance of 15 mm or less from the end on the phosphor screen side of the neck portion toward the cathode.

In the prior art, since the main lens of the electron gun is positioned away from a deflection magnetic field, a voltage is supplied to the anode of the electron gun from an inner wall of the neck portion of the cathode ray tube.

According to the present invention, since the main lens of the electron gun is not required to be disposed away from a deflection magnetic field and can be positioned nearer the phosphor screen, a voltage can be supplied to the anode of the electron gun from a portion other than the inner wall of the neck portion of the cathode ray tube.

In a cathode ray tube in which a high electric field is created in a narrow space, it is one of important techniques to stabilize a withstand voltage characteristic for making stable the quality thereof. The maximum electric field strength is produced in the vicinity of a main lens of an electron gun. The electric field in the vicinity of the main lens is influenced by a graphite film coated on an inner wall of a neck portion of the cathode ray tube for supplying a voltage to an anode of an electron gun and on bonding of foreign particles remaining in the cathode ray tube and sticking to the inner wall of the neck portion.

According to the present invention, since a main lens of an electron gun can be shifted from the neck portion toward a phosphor screen, the withstand voltage characteristics can be significantly improved.

(26) When an electron beam spot is formed at the center of a phosphor screen, the electron beam is not subjected to the effect of a deflection magnetic field, so that means for suppressing distortion of the electron beam due to the deflection magnetic field is not needed and thereby the lens action of the electron gun becomes that of a focusing system of rotational symmetry. Thus, the electron beam spot diameter on the phosphor screen can be further reduced.

(27) According to the present invention, in addition to correction of deflection defocusing by establishing in a deflection magnetic field an axial-boundary varying uniform magnetic field region corresponding to the deflection magnetic field, a dynamic voltage corresponding to deflection may be applied to one or more of electrodes of an electron gun for exerting a more appropriate focusing action on an electron beam over the entire phosphor screen thereby providing better resolution over the entire phosphor screen. Further, the required dynamic voltage can be lowered.

(28) According to the present invention, in addition to correction of deflection defocusing by establishing in a deflection magnetic field an axial-boundary varying uniform magnetic field region corresponding to the deflection magnetic field, at lest one of electric fields created by a plurality of electrostatic lenses formed of a plurality of electrodes of an electron gun may be made so non-axially-symmetric as to form an electrostatic lens for providing an approximately circular or rectangular electron beam spot at the center of the phosphor screen in a large beam current region and having a higher focus voltage optimized for a diameter of a beam spot in a first direction parallel with scanning lines than that optimized for a diameter of the beam spot in a second direction perpendicular to the first direction, and an electrostatic lens having a diameter of an electron beam spot in the second direction optimized for the shadow mask aperture pitch or the density of the scanning lines in the second direction, rather than that in the first direction, at the center of the phosphor screen in a small beam current region and having a higher focus voltage optimized for a diameter of a beam spot in the first direction than that optimized for a diameter of the beam spot in the second direction. These lenses created by the non-axially-symmetric electric fields provide good focus characteristics with no appearance of moire over the entire phosphor screen and over the entire current region for an electron beam.

(29) In addition, "non-axially-symmetric" used in this specification means any loci other than a locus of points equidistant from a fixed point such as a circle. For example, a non-axially-symmetric beam spot means a non-circular beam spot.

(30) As described in the paragraph (25), according to the present invention, since deflection defocusing is corrected by establishing in a deflection magnetic field an axial-boundary-varying uniform magnetic field region corresponding to the deflection magnetic field, a main lens of an electron gun can be disposed nearer the deflection magnetic field used for the cathode ray tube as compared with the prior art.

Since the above deflection magnetic field penetrates into a main lens of the electron gun, an electrode near the phosphor screen than to the main lens must be configured such that an electron beam is prevented from impinging. According to the optimum design of the present invention for the in-line type electron gun including a plurality of electrodes, a shield cup has a single opening with no partition which is common to three electron beams.

At the same time, in the case where the pole pieces for correcting deflection defocusing by establishing in a deflection magnetic field an axial-boundary-varying uniform magnetic field region corresponding to the deflection magnetic field are disposed on the phosphor screen side beyond an electron beam aperture formed in the bottom of the shield cup, it is preferable that the electrode supporting the pole pieces has an opening of an area corresponding to the area enclosed by the pole pieces in transverse cross section. With this configuration, even if the trajectory of a deflected electron beam enters further into the uniform magnetic field region, the possibility of the electron beam impinging upon the electrode to which the pole pieces are attached is reduced so that the effect of the uniform magnetic field region corresponding to the deflection magnetic field is made the most of and thereby the uniformity of resolution over the entire phosphor screen can be improved.

(31) According to the present invention, to correct deflection defocusing by establishing in a deflection magnetic field an axial-boundary-varying uniform magnetic field region corresponding to the deflection magnetic field in an in-line type electron gun including a plurality of electrodes, the structure of a portion associated with the center electron beam in the pole pieces for establishing the uniform magnetic field region is made different from the structure of a portion associated with the side electron beams. This is effective for adjusting the balance of resolution between the three electron beams on the phosphor screen.

With respect to a pair of pole pieces disposed on opposite sides of a side electron beam in the in-line direction for establishing the uniform magnetic field region, one of the pair of pole pieces on the center electron beam side can be made different in structure from the other of the pair on the other side, for reducing coma caused by the deflection magnetic field.

Although the effects of individual techniques of the present invention have been described, by combination of two or more of the techniques, the cathode ray tube of the present invention can further improve uniformity of resolution over the entire phosphor screen, further improve resolution over the entire current region at the center of the phosphor screen, and shorten the axial length of the cathode ray tube.

Further, by the use of such a cathode ray tube, there can be obtained an image display unit capable of improving uniformity of resolution over the entire phosphor screen, improving resolution over the entire current region at the center of the phosphor screen, and shortening the depth thereof.

Next, there will be described a mechanism of improving focus characteristics and resolution of a cathode ray tube using the electron gun of the present invention.

Figure 21:
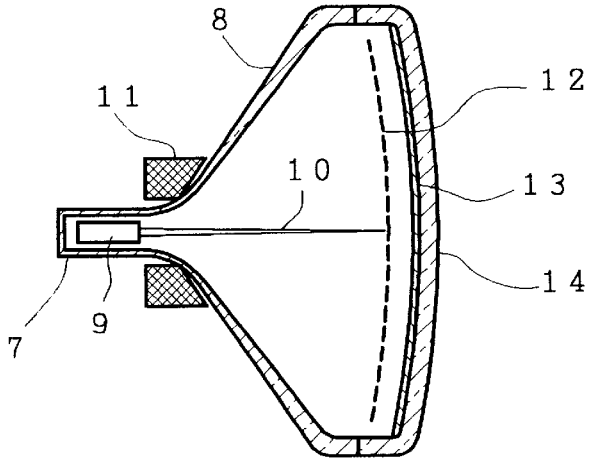
FIG. 21 is a schematic sectional view illustrating a shadow mask type cathode ray tube having an in-line electron gun.

FIG. 21 is a schematic sectional view illustrating a shadow mask type color cathode ray tube including an in-line type electron gun. In FIG. 21, reference numeral 7 indicates a neck portion; 8 is a funnel portion; 9 is an electron gun contained in the neck portion 7; 10 is an electron beam; 11 is a deflection yoke; 12 is a shadow mask; 13 is a phosphor film forming a phosphor screen; and 14 is a panel (screen) portion.

Referring to FIG. 21, in the cathode ray tube of this type, the electron beam 10 emitted from the electron gun 9 is deflected in the horizontal and vertical directions by the deflection yoke 11 and is made to pass through the shadow mask 12 to excite the phosphor film 13 to luminesce, and the pattern reproduced on the screen by the luminescence is observed as an image from the panel 14 side.

Figure 22:
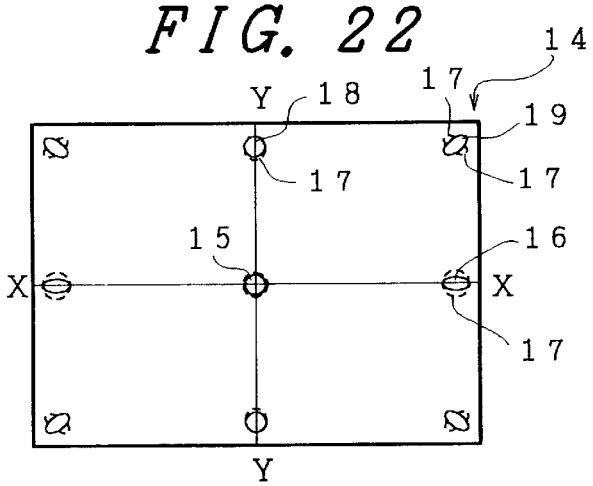
FIG. 22 is a view illustrating electron beam spots produced when peripheral phosphors are excited by an electron beam adjusted for a circular spot at the center of the screen.

FIG. 22 is a view illustrating electron beam spots produced when peripheral phosphors are excited by an electron beam adjusted for a circular spot at the center of the screen. In FIG. 22, reference numeral 14 indicates a viewing screen; 15 is a beam spot at the center of the screen; 16 is a beam spot at the end in the horizontal (X-X) direction of the screen; 17 is a halo; 18 is a beam spot at the end in the vertical (Y-Y direction of the screen; and 19 is a beam spot at the end in the diagonal direction (corner portion) of the screen.

FIG. 23 is a view illustrating a deflection magnetic field distribution of a cathode ray tube. In FIG. 23, character H indicates a horizontal deflection magnetic field distribution, and V is a vertical deflection magnetic field distribution.

The recent color cathode ray tube adopts an unhomogeneous magnetic field distribution to simplify convergence adjustment, in which a pincushion-shaped magnetic field distribution is used for the horizontal deflection and a barrel-shaped magnetic field distribution is used for the vertical deflection as shown in FIG. 23.

The shape of a bright spot of the electron beam 10 is not circular at the periphery of the screen due to the above magnetic field distribution, the difference in length between the trajectory of electron beams to the center and the periphery of the phosphor screen from the main lens of the electron gun, and oblique impingement of the electron beam 10 upon the periphery of the phosphor screen 13.

As shown in FIG. 22, while the beam spot 15 at the center is circular, the beam spot 16 at the end in the horizontal direction is horizontally elongated and also produces a halo 17. As a result, the size of the beam spot 16 at the end in the horizontal direction becomes large and also the contour of the beam spot 16 becomes blurred by the effect of the halo 17, so that resolution is deteriorated and the image quality is severely degraded.

In the case where the current of the electron beam 10 is small, the diameter of the electron beam 10 in the vertical direction is excessively reduced. This causes optical interference with the vertical aperture pitch of the shadow mask 12, to thereby exhibit a moire phenomenon and degrade the image quality.

The spot 18 at the end in the vertical direction of the screen is flattened because the electron beam 10 is vertically focused by the vertical deflection magnetic field and also it produces the halo 17, to thereby degrade the image quality.

The electron beam spot 19 at the corner portion on the screen is horizontally elongated similarly to the spot 16 and also flattened similarly to the spot 18. Further, at the spot 19, there occurs rotation of the electron beam 10, which produces the halo 17 and increases the diameter of the bright spot itself, to thereby severely degrade the image quality.

For a cathode ray tube used for a color TV receiver set or the like, when the maximum deflection angle is fixed, a distance between a main lens and a phosphor screen increases with an increasing screen size of the cathode ray tube. Accordingly, since the increase in screen size of the cathode ray tube increases the spot diameter of an electron beam on the phosphor screen, resolution does not increase so much as the screen size increases.

According to the embodiments of the present invention, the distance between the main lens and the phosphor screen of the cathode ray tube can be shortened as compared with the prior art cathode ray tube and the present invention is compatible with the enlargement of the diameter of the main lens so that, even if the screen size of the cathode ray is increased, the effect of the space-discharge repulsion can be decreased to reduce the spot diameter of an electron beam on the phosphor screen. As a result, according to the present invention, there can be provided a high resolution cathode ray tube.

Shortening of the overall length $L_4$ of the cathode ray tube has been difficult and limited because it was difficult to shorten the length of an electron gun while maintaining focus characteristics of the electron gun; however, according to the present invention, by shortening the distance between the main lens and the phosphor screen, the overall length of the cathode ray tube can be significantly shortened as compared with the prior art example without changes in cathodes to a main lens of the electron gun.

In general, in a color TV receiver set and a terminal display system of a computer, the depth of a cabinet is dependent on the overall length $L_4$ of a cathode ray tube. In particular, the recent color TV receiver set has a tendency that the screen size is increased to the extent that the depth of the cabinet is not negligible in a home. When the color TV receiver set is arranged side by side with other furniture, only several tens mm of a difference in depth can cause a problem. As a result, shortening of the depth of the cabinet is significantly effective in terms of coefficient of utilization of space and ease of use.

According to the embodiments of the present invention, there can be provided a color TV receiver set and a terminal display system of a computer the depth of a cabinet of which can be significantly shortened as compared with a conventional cabinet without harming the focus characteristics by shortening the overall length of the cathode ray tube, providing a good sales point.

In general, a color TV receiver set, a completed cathode ray tube, and parts for a cathode ray tube such as a funnel are significantly larger in volume than an electronic part such as a semiconductor element, and consequently, a transportation cost per unit number becomes high. In particular, when a distance of transportation is longer such as for exports, this is not negligible. According to the embodiment of he present invention, since a color TV receiver set in which the overall length of a cathode ray tube is shortened and the depth of a cabinet is also shortened can be provided, the transportation cost can be saved.

As described above, the present invention provides a cathode ray tube having an electron gun which is cable of improving focus characteristics and providing good resolution over the entire screen and over the entire electron beam current region, particularly, without dynamic focusing, and which is also capable of reducing moire in a small-current region; and an image display system including the cathode ray tube.

The present invention also provides a cathode ray tube which is capable of improving the focus characteristics and shortening the overall length of a cathode ray tube; and an image display system including the cathode ray tube.

What is claimed is:

1. A cathode ray tube including a phosphor screen and an electron gun comprising:

a plurality of electrodes and a deflection device; and a plurality of magnetic pieces being disposed on opposite sides in a direction of a scanning line of an electron beam of a trajectory of an undeflected electron beam in a magnetic deflection field generated by said deflection device;

wherein said plurality of magnetic pieces have a portion extending in a direction of an axis of said cathode ray tube on each of said opposite sides, and said portion includes a pair of parts disposed above and below a plane containing said axis and said scanning line and having a first axial length greater than a second axial length of said portion as measured in said plane.

2. A cathode ray tube according to claim 1, wherein said second axial length is shortest in said portion in the direction of said axis.

3. A cathode ray tube according to claim 1, wherein a length of said portion in the direction of said axis is greatest at extremities above and below said plane.

4. A cathode ray tube according to claim 1, wherein said plurality of magnetic pieces are disposed at an axial position where a magnetic flux density thereof is at least equal to 5% of a maximum of said magnetic deflection field.

5. A cathode ray tube according to claim 1, wherein said plurality of magnetic pieces are disposed at an axial position within a distance of 50 mm from a magnetic core of said deflection device.

6. A cathode ray tube according to claim 1, wherein said plurality of magnetic pieces are disposed at a position having a magnetic flux density B of said magnetic deflection field satisfying the following inequality:

$$B\cdot(Eb)^{-1/2} \geqq 0.02\ \mathrm{mT}\cdot(\mathrm{kV})^{-1/2}$$

where B is in mT and Eb is an anode voltage applied to an electrode nearest to said phosphor screen of said plurality of electrodes in kilovolts.

7. A cathode ray tube according to claim 1, wherein a spacing between two opposing ones of said portions is not less than 10% of a diameter of an electron beam opening in an anode of said electron gun forming a main lens in a direction perpendicular to said scanning line.

8. A cathode ray tube according to claim 1, wherein a diameter in a direction perpendicular to said scanning line of an electron beam opening in an electrode of said electron gun having said plurality of magnetic pieces attached thereto is larger than a diameter thereof in a direction of said scanning line.

9. A cathode ray tube according to claim 1, wherein an electrode of said electron gun having said plurality of magnetic pieces attached thereto has a pair of slots located on each side of an electron beam aperture in a direction perpendicular to said scanning line.

10. A cathode ray tube according to claim 1, wherein said electron gun generates three in-line electron beams and an electrode of said electron gun having said plurality of magnetic pieces attached thereto has a single beam opening shared by said three in-line electron beams.

11. A cathode ray tube including a phosphor screen and an electron gun comprising:

a plurality of electrodes and a deflection device; and a plurality of magnetic pieces being disposed on opposite sides in a direction of scanning line of an electron beam of a trajectory of an undeflected electron beam in a magnetic deflection field generated by said deflection device;

wherein said plurality of magnetic pieces have a portion extending in a direction of an axis of said cathode ray tube on each of said opposite sides, and said portion includes a pair of parts disposed above and below a plane containing said axis and said scanning line and having a first axial length shorter than a second axial length of said portion as measured in said plane.

12. A cathode ray tube according to claim 11, wherein said second axial length is greatest in said portion in the direction of said axis.

13. A cathode ray tube according to claim 11, wherein a length of said portion in the direction of said axis is smallest at extremities above and below said plane.

14. A cathode ray tube according to claim 11, wherein said plurality of magnetic pieces are disposed at an axial position where a magnetic flux density thereof is at least equal to 0.05% of a maximum of said magnetic deflection field.

15. A cathode ray tube according to claim 11, wherein said plurality of magnetic pieces are disposed at an axial position within a distance of 50 mm from a magnetic core of said deflection device.

16. A cathode ray tube according to claim 11, wherein said plurality of magnetic pieces are disposed at a position having a magnetic flux density B of said magnetic deflection field satisfying the following inequality:

$$B\cdot(Eb)^{-1/2} \geqq 0.003\ \mathrm{mT}\cdot(\mathrm{kV})^{-1/2}$$

where B is in mT and Eb is an anode voltage applied to an electrode nearest to said phosphor screen of said plurality of electrodes in kilovolts.

17. A cathode ray tube according to claim 11, wherein a spacing between two opposing ones of said portions is not less than 10% of a diameter of an electron beam opening in an anode of said electron gun forming a main lens in a direction perpendicular to said scanning line.

18. A cathode ray tube according to claim 11, wherein a diameter in a direction perpendicular to said scanning line of an electron beam opening in an electrode of said electron gun having said plurality of magnetic pieces attached thereto is larger than a diameter thereof in a direction of said scanning line.

19. A cathode ray tube according to claim 11, wherein an electrode of said electron gun having said plurality of magnetic pieces attached thereto has a pair of slots located on each side of an electron beam aperture in a direction perpendicular to said scanning line.

20. A cathode ray tube according to claim 11, wherein said electron gun generates three in-line electron beams and an electrode of said electron gun having said plurality of magnetic pieces attached thereto has a single beam opening shared by said three in-line electron beams.

* * * * *